US005793392A

United States Patent [19]

Tschida

[11] Patent Number: 5,793,392

[45] Date of Patent: Aug. 11, 1998

[54] PRINTING APPARATUS AND METHOD

[76] Inventor: Mark J. Tschida, 2697 E. County Rd. E., White Bear Lake, Minn. 55110

[21] Appl. No.: 490,055

[22] Filed: Jun. 13, 1995

[51] Int. Cl.[6] ..... B41J 2/145; B41J 2/15; B41J 2/015

[52] U.S. Cl. ..... 347/40; 347/20

[58] Field of Search ..... 347/40, 18, 67, 347/41, 54, 20, 104, 12; 400/124.13

[56] References Cited

U.S. PATENT DOCUMENTS

| | | | |
|---|---|---|---|
| 4,016,965 | 4/1977 | Wirth et al. | 197/1 R |
| 4,034,841 | 7/1977 | Ohyama et al. | 197/1 R |
| 4,069,486 | 1/1978 | Fox | 347/41 |
| 4,079,824 | 3/1978 | Ku | 197/1 R |
| 4,129,390 | 12/1978 | Bigelow et al. | 400/121 |
| 4,236,836 | 12/1980 | Hodne | 400/124 |
| 4,300,845 | 11/1981 | Martin et al. | 400/124 |
| 4,441,830 | 4/1984 | Italiano | 400/124 |
| 4,462,706 | 7/1984 | Matschke | 400/124 |
| 4,468,142 | 8/1984 | Berrey et al. | 400/124 |
| 4,470,713 | 9/1984 | Rossopoulos | 400/124 |
| 4,534,287 | 8/1985 | Meloni | 101/93.05 |
| 4,539,905 | 9/1985 | Zenner | 101/93.05 |
| 4,548,521 | 10/1985 | Wirth et al. | 400/124 |
| 4,552,064 | 11/1985 | Sanders, Jr. et al. | 101/93.05 |
| 4,571,101 | 2/1986 | Sakaida et al. | 400/124 |
| 4,582,437 | 4/1986 | Wang | 400/124 |
| 4,723,129 | 2/1988 | Endo et al. | 347/43 |
| 4,802,781 | 2/1989 | Sheerer | 400/124 |
| 4,840,501 | 6/1989 | Wong et al. | 400/124 |
| 4,895,464 | 1/1990 | Rubinshstein | 400/124 |
| 4,924,241 | 5/1990 | Parks et al. | 347/107 |
| 4,953,995 | 9/1990 | Sims et al. | 400/121 |
| 4,968,160 | 11/1990 | Ishizuka | 400/124 |
| 4,985,715 | 1/1991 | Cyphert et al. | 347/54 |
| 5,077,679 | 12/1991 | Williamson et al. | 395/105 |
| 5,079,571 | 1/1992 | Eriksen | 346/140 R |
| 5,124,720 | 6/1992 | Schantz | 346/1.1 |
| 5,139,355 | 8/1992 | Yeager | 400/616.1 |
| 5,188,465 | 2/1993 | Johnson et al. | 400/121 |
| 5,209,585 | 5/1993 | Yamamoto et al. | 400/124 |
| 5,236,266 | 8/1993 | Mitsuishi et al. | 400/124 |

FOREIGN PATENT DOCUMENTS

| | | | |
|---|---|---|---|
| 0019706 | 5/1979 | European Pat. Off. . | |
| 0023433 | 2/1981 | European Pat. Off. . | |
| 0060969 | 3/1981 | European Pat. Off. . | |
| 0462684 | 6/1990 | European Pat. Off. . | |
| 595657 | 5/1994 | European Pat. Off. | 347/43 |
| 3036041 | 2/1991 | Japan . | |
| WO89/10264 | 11/1989 | WIPO . | |

OTHER PUBLICATIONS

R. J Harris, "Displaceable Print Wire Guide", *IBM Technical Disclosure Bulletin*, vol. 26, No. 8, p. 3985, (Jan. 1984).

"International Search Report for Application No. PCT/US 96/10173 mailed on Dec. 13, 1996 by M. Iverstam", 2 pgs.

PCT Search Report for International Application No. PCT/US 96/10173 dated Feb. 25, 1997, completed by R. DeGroot, 2 pages.

John D. Kraus; "Sec 3–4, Ink Jet Printer;" *Electromagnetics;* Fourth Edition; McGraw–Hill, Inc.; 117–118 (1992).

*Primary Examiner*—N. Le
*Assistant Examiner*—Thinh Nguyen
*Attorney, Agent, or Firm*—Dicke, Billig & Czaja, P.A.

[57] ABSTRACT

A printing system prints an image on a printing surface of a printing medium with a print head array having multiple columns of print heads, such as electro-mechanical actuator impact or non-impact print heads, ink-jet print heads, or bubble jet print heads, having varying positions in a vertical dimension in the print head array for printing in a corresponding printable column area of the image. The printing medium is moved relative to the print head array in the vertical dimension to cause selected non-contiguous portions of a defined printable segment along a horizontal dimension to be printed in each printable column area by the print heads having varying positions in the vertical dimension. Further movement in the vertical dimension causes selected non-contiguous portions of multiple defined printable segments to be printed. By combining the movement in the vertical dimension with movements of the print head array relative to the printing medium in the horizontal dimension of not more than the widest distance between any two consecutive non-contiguous portions, all defined printable segments contained in the image are printed.

32 Claims, 13 Drawing Sheets

PRINTING APPARATUS AND METHOD

THE FIELD OF THE INVENTION

The present invention relates generally to dot matrix printers, and more particularly to various dot matrix printers which include printing heads, such as an electro-mechanical actuator print head or an ink-jet print head for printing at high-speeds with high resolutions.

BACKGROUND OF THE INVENTION

Dot matrix printers typically include at least one print head with a plurality of individual printing elements arranged within the print head. A dot matrix printer typically actuates individual printing elements in the print head in a pattern of operation that is controlled by a stream of data in successive steps as the print head traverses a printing surface of a printing medium such as paper. During each step, the print head prints an area of dots and then move horizontally to a new position to print a succeeding area of dots. This process is repeated to produce a horizontal line of characters or other such image across the printing medium. After one horizontal line is printed, the paper is typically incrementally moved in the vertical direction to permit another horizontal line of the image, such as a row of characters, as described above.

Thus, dot matrix printers require successive actuation of one or more print heads typically including multiple printing elements arranged across a relative path of movement between the printing medium and the print head. One technique to progressively increase printing speed has involved printing while moving in opposite directions back and forth in a rectangular path. Another technique is the using of multiple printing heads arranged side-by-side along a rectangular path. Another technique for increasing speed, is using double or multiple height print heads arranged across the rectangular path to simultaneously print two or more rows of characters during each traverse of the printing medium.

There are many specific examples of previous attempts to rearrange dot matrix print heads or printing elements therein for increasing printing speeds and/or image resolution. For example, the Sims et al. U.S. Pat. No. 4,953,995 discloses a method and apparatus for printing multiple lines of characters simultaneously on a dot matrix printer. The Matschke U.S. Pat. No. 4,462,706 discloses a stacked array of print heads which can be stacked horizontally or vertically. The Sanders, Jr. et al. U.S. Pat. No. 4,552,064 discloses a print head which can have the mechanical dimensions of a 34 pin head being two inches wide, 1.5 inches thick, and 14.2 inches in length. The Hodne U.S. Pat. No. 4,236,836 discloses a dot matrix impact printer wherein 44 to 132 print heads can be utilized to print one line at a time. The Mitsuishi et al. U.S. Pat. No. 5,236,266 discloses a stacked print wire driving device. The Ku U.S. Pat. No. 4,079,824 discloses a double-speed dot matrix print head using two columns of print wires.

As there are many forms of dot matrix printers presently available, there are a correspondingly wide variety of print heads which can be used in a dot matrix printer. For example, in electro-mechanical actuator impact print heads, a plurality of print wires are selectively driven by corresponding solenoids to impact a printing surface directly with or through a transfer ribbon. Another type of print head is an ink-jet print head which uses a number of individual ink jets to pulse droplets of ink in spacial combinations to print characters as a sequence of dots. Another type of dot matrix print head is the thermal printer of the type in which printing of data is carried out by contact of multiple heated printing elements to heat sensitive paper or to an intervening thermal transfer ribbon to print data on ordinary paper.

Electro-mechanical actuator impact print heads typically use a uniform matrix of print elements. For example, one common type of electro-mechanical actuator print head employs seven or nine print elements aligned in a vertical column perpendicular to the path of the moving print head. In addition, electro-mechanical actuator print heads with 18 or 24 print elements having two vertical columns of 9 and 12 print elements respectively are commonly employed. The conventional print heads are designed to print a single line of characters during each traverse of the printing medium. The additional column of print elements in the 18 and 24 element print heads are used to print multiple columns in the same line of characters.

One problem with the electro-mechanical solenoid dot matrix impact print heads is that the speed of the print head is inherently limited by the amount of heat produced by the solenoid type arrangement. Various techniques have been used to cool the solenoid print head such as in the Sakaida et al. U.S. Pat. No. 4,571,101 which discloses a print head for impact type dot matrix printers including air cooling means for cooling the interior of the print head to reduce the temperature due the generation of heat in the solenoid coils. The Sakaida et al. patent also discloses prior art techniques of using cooling fins or using fans to cool a solenoid type print head.

Previous electro-mechanical actuator impact print heads for dot matrix printers use some spring biasing mechanism to resiliently position the print wire in a non-print position and to return the print wire to the non-print position from the print position. Typically, a magnetic flux produces a force necessary to drive the print wire to the print position. The force of the spring is constant. Therefore, no matter how much magnetic flux and tractive force is generated to increase the speed in moving the print wire from the non-print position to the print position, the time to return the print wire from the print position to the non-print position is constant. Increasing the force of the spring necessarily requires increasing the magnetic flux and tractive force The ink-jet print head provides faster and quieter printing on a printing medium as compared to the conventional dot matrix electro-mechanical actuator impact print head. The ink-jet print head delivers ink to the printing medium by deflecting ink droplets in a manner similar to that in which a cathode-ray tube deflects electrons. The ink-jet print head includes a nozzle to produce a continuous stream of ink droplets. A charging plate charges the ink droplets so that the ink droplets can be electro-statically deflected with deflection plates. The deflection plates deflect droplets onto the printing medium and a funnel is typically included to collect undeflected droplets when droplets are not required to reach the printing medium to form an image. In the typical ink-jet print head, the deflecting potential produced by the deflecting plates is fixed, and the amount of deflection desired is controlled by the amount of charge produced in the droplets with the charging plates.

The ink-jet print head is typically mounted on a carriage which moves horizontally, or in other words, substantially perpendicular to a deflection direction, to enable an ink-jet type dot matrix printer to produce a line of characters or type. One advantage of the ink-jet print head is that other than the movement of the carriage and the drops of ink moving through the ink-jet print head, there are no moving parts such as in the electro-mechanical actuator impact print head. Previous ink-jet print heads have achieved printing rates of 100 character per second with 1,000 droplets per character. Even with this increased speed, a faster ink-jet printer is desired.

Therefore, there is a need in the art for an improved printing system comprising multiple printing heads for increasing resolution and printing speed through the arrangement of the print heads in the printing system. In addition, there is a need for improved print heads, such as an improved electro-mechanical actuator print head and an improved ink-jet print head, for increasing resolution and printing speed.

SUMMARY OF THE INVENTION

The present invention provides a printing system and method for printing an image having a defined image width on a printing surface of a printing medium. The printing system includes a print head array having multiple columns of print heads. Each column includes a plurality of print heads having varying positions in a first dimension in the print head array for printing in a corresponding printable column area of the printing medium having a corresponding defined printable column width. The multiple columns of print heads are arranged for printing throughout the defined image width of the image. A first mechanism moves the printing medium relative to the print head array in the first dimension to cause selected non-contiguous portions of a defined printable segment along a second dimension substantially perpendicular to the first dimension to be printed in each printable column area by the print heads having varying positions in the first dimension if a corresponding portion of the image is contained in the selected non-contiguous portions of the corresponding defined printable segment of the corresponding printable column area. Further movement in the first dimension causes selected non-contiguous portions of multiple defined printable segments to be printed to fill the corresponding image portions of each column area. A second mechanism moves the print head array relative to the printing medium in the second dimension. A movement in the second dimension not more than the widest distance between any two consecutive non-contiguous portions of any defined printable segment in combination with the movement in the first dimension is sufficient to print all defined printable segments contained in the image.

A variety of print head types can be used in the printing system of the present invention such as electro-mechanical actuator print heads, ink-jet print heads, and bubble jet printing heads. In fact, the print head array can comprise more than one type of print head. If electro-mechanical actuator print heads are used in the print head array, the printing system preferably includes a cooling system for cooling the print heads with a refrigerant.

In another form of the present invention, a printing system prints an image having a defined image width and a defined image length on a printing surface of a printing medium. The printing system includes a print head array including multiple columns and rows of print heads arranged for printing throughout the defined image width and the defined image length of the image. Each print head is assigned a corresponding printable area of the printing medium having a corresponding defined area width and a defined area length. The print head array is moved in a first dimension relative to the printing medium. A movement in the first dimension not more than the defined area length of the longest printing area is sufficient to print throughout the defined image length of the image. The print array is moved in a second dimension substantially perpendicular to the first dimension relative to the printing medium. A movement in the second dimension not more than the defined area width of the widest printing area is sufficient to print throughout the defined image width of the image.

In this second form of the invention, the printing system can include a third mechanism for moving the printing medium in a continuous movement or for moving the printing medium in relatively small incremental movements to enable each print head array to print more than one printable area. In addition, the rows can include print heads, which are staggered by having varying positions in the first dimension. Likewise, the columns include print heads, which are staggered by having varying positions in the second dimension.

The present invention also provides an electro-mechanical actuator print head including at least two magnets, at least one of which is an electromagnet. A printing pin is coupled to a selected one of the at least two magnets. A power source supplies power to the at least one electromagnet, and changes the polarity of the at least one electromagnet to a first polarity to cause the printing pin to move from a non-print position to a print position, and changes the polarity of the at least one electromagnet to a second polarity to cause the printing pin to move from a print position to a non-print position.

The electro-mechanical actuator print head of the present invention preferably makes at least one of the changes in position of the printing pin by an attractive force between two of the at least two magnets. The magnets are preferably half toroidal shaped. The electro-mechanical actuator print head of the present invention preferably includes at least three magnets to permit both of the changes in position of the printing pin to be caused by attractive force between selected ones of the at least three magnets.

The present invention also provides an electro-mechanical actuator print head including at least two magnets, at least one of which is an electromagnet. A tubular shaped pin is coupled to a selected one of the at least two magnets. The tubular pin includes a hollow portion having an opening at a printing end of the pin. A power source supplies power to the at least one electromagnet, and changes the polarity of the at least one electromagnet to a first polarity to cause the printing pin to move from a non-print position to a print position to permit delivery of ink on a printing medium without impacting the printing medium.

The present invention also provides an ink-jet print head including an ink tube for carrying ink. A solenoid type electromagnet has a hollow portion having a first opening for receiving ink from the ink tube and a second opening at a printing end of the solenoid. A power source supplies power to the solenoid type electromagnet to energize the solenoid type electromagnet to force ink from the solenoid type electromagnet.

The ink-jet print head can include magnetized ink or optionally includes charging plates for electrically charging a portion of the ink in the ink tube.

BRIEF DESCRIPTION OF THE DRAWINGS

FIGS. 9A–9C illustrates various structural shapes of the magnets according to the present invention for allowing pins or tubes to pass there through.

DESCRIPTION OF THE PREFERRED EMBODIMENTS

Figure 1:
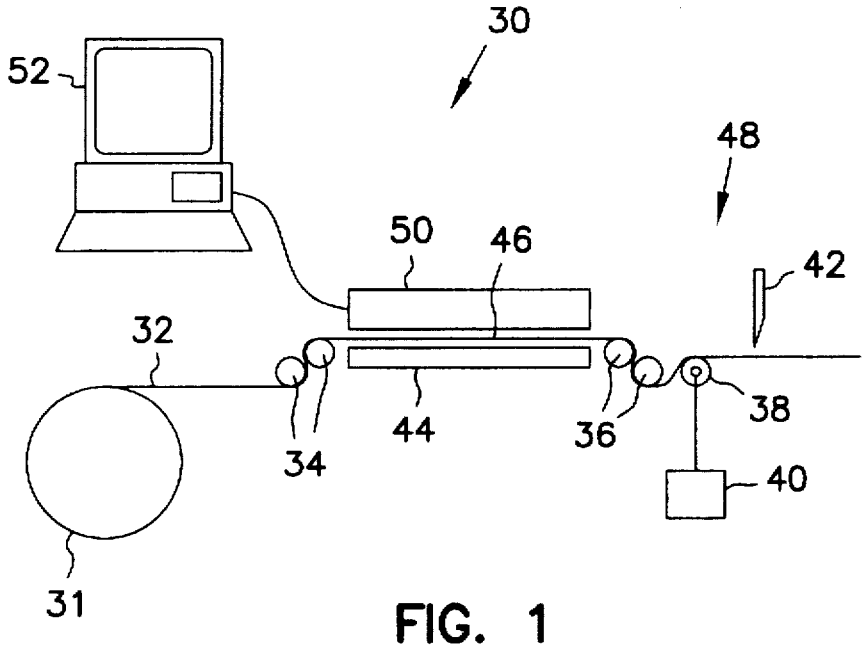
FIG. 1 is a schematic diagram illustrating a printing system according to the present invention.

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defmed by the appended claims.

Like reference characters will be used for like elements throughout the drawings.

Dot Matrix Printing System with Print Head Array

A dot matrix printing system, according to the present invention is illustrated in schematic diagram form generally at 30 in FIG. 1. A roll 31 of printing paper 32 provides a printing medium to be printed upon. Intake rollers 34 feed the paper through to outtake rollers 36. A motor driven roller 38 is driven by a motor 42 to pull paper 32 from roll 31 and feed the paper to a cutter 42. Paper 31 is positioned over a plate or other suitable surface for printing 44. A print head array 50 comprising a plurality of print heads, organized in rows and columns, prints an image on a top surface 46 of printing paper 32. As indicated at 48, a printed image on the paper is fed by the roller and motor system past cutter 42 which is used to cut and separate finished printed images.

The print heads of print head array 50 according to the present invention are preferably controlled by a computer 52 operating according to a software program to control when the print heads are activated to print the image, which is typically stored in computer readable format. Printing system 30 includes the print head array 50 according to the present invention controlled by computer 52, but is otherwise implemented in conventional printing system elements and can be embodied in various form. For example, in place of cutter 42, the printed image can be rolled onto another roller. An alternative embodiment of printing system 30 includes two print head arrays 50 for simultaneously printing on both sides of the printing medium, where one of the print head arrays 50 replaces printing surface 44.

Figure 2:
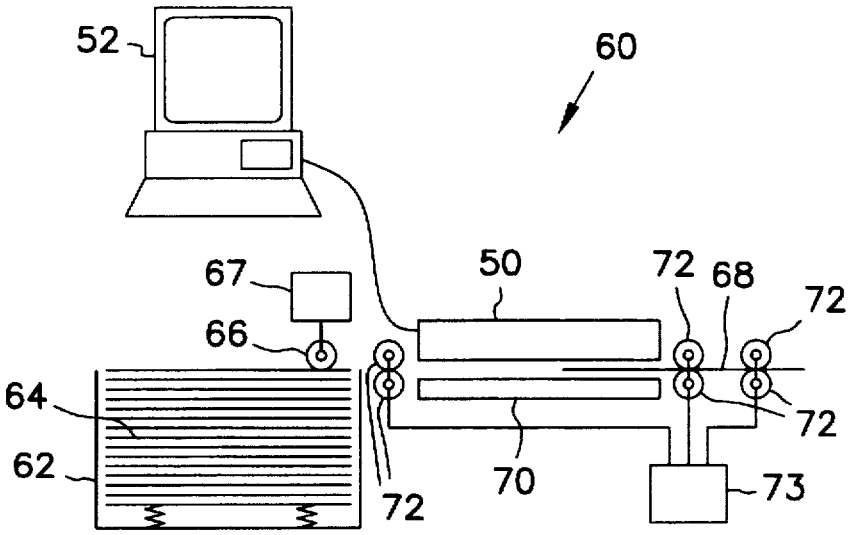
FIG. 2 is a schematic diagram illustrating another preferred embodiment of a printing system according to the present invention.

Another embodiment of a printing system according to the present invention is illustrated generally at 60 in FIG. 2. Printing system 60 includes print head array 50 for printing images on individual sheets of paper. Printing system 60 includes a paper holder 62 for holding a stack of individual sheets of paper 64 to be printed upon. An intake roller 66 is motor driven with a motor 67 to grab an individual sheet of paper 68 and position the sheet of paper over a plate or other suitable printing surface 70. Rollers 72 are motor driven by a motor system 73 in a conventional manner to move the individual sheet of paper 68 through and underneath print head array 50 for printing.

There are many known means for moving paper, either in individual sheets, in rolls, or by other known means through a printing mechanism in conventional printers and any of these known methods are suitable for the present invention. The speed and timing of the movement is, however, as discussed below, critical and the printing system will accordingly preferably comprise a properly precisioned and fast paper mover capable of moving the paper in a continuous motion, moving the paper in very small incremental movements, or moving the paper quickly under the print head array to stationary positions and quickly out again, to comply with the requirements of the present invention. As discussed below, the vertical dimension movement of the paper is critical to some embodiments of the present invention, but in these embodiments the printing paper only needs to move vertically relative to print head array 50. Therefore, an alternative embodiment of the present invention (not shown) includes a mechanism for vertically moving the print head array rather than the printing paper to accomplish the task of moving the paper past the entire print head array.

Figure 3A:
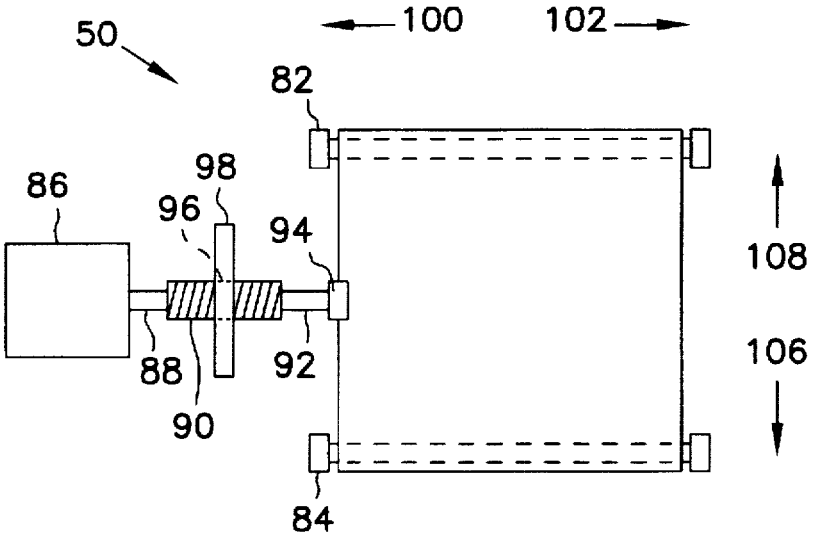
FIG. 3A is a schematic diagram illustrating a print head array and a corresponding horizontal movement mechanism to move the print head array in a horizonal dimension.

FIG. 3A illustrates in schematic diagram form a top view of print head array 50 according to the present invention. Print head array 50 rides on guiderails 82 and 84. Guiderails 82 and 84 preferably include rollers for ease of movement on the guiderails. Guiderails 82 and 84 are supported in any known manner to support the weight of print head array 50. A motor 86 drives a shaft 88. Shaft 88 is attached to a threaded shaft 90. Threaded shaft 90 is attached to a shaft 92. Shaft 92 is coupled through a mechanical coupling 94 to print head array 50. Threaded shaft 90 is threadedly mounted within an opening 96 defined within a support plate 98.

Thus, in the configuration illustrated in FIG. 3A, print head array 50 is movably mounted on guiderails 82 and 84 for horizontal dimension movement, indicated by arrows 100 and 102. Mechanical coupling 94 removes the rotational movement of the shaft system including shafts 88, 90, and 92 to translate directly the horizontal movement into movements of print head array 50. Typically, when motor 86 drives the shaft system in a counter-clock-wise direction, threaded shaft 90 is threaded out of opening 96 to correspondingly move print head array 50 towards motor 86 in a negative horizontal movement, as indicated by arrow 100. When motor 86 drives the shaft system in a clockwise direction, the threaded shaft 90 is threaded into threaded opening 96 to correspondingly move print head array 50 away from motor 86 in a positive horizontal movement, as indicated by arrow 102.

Figure 3B:
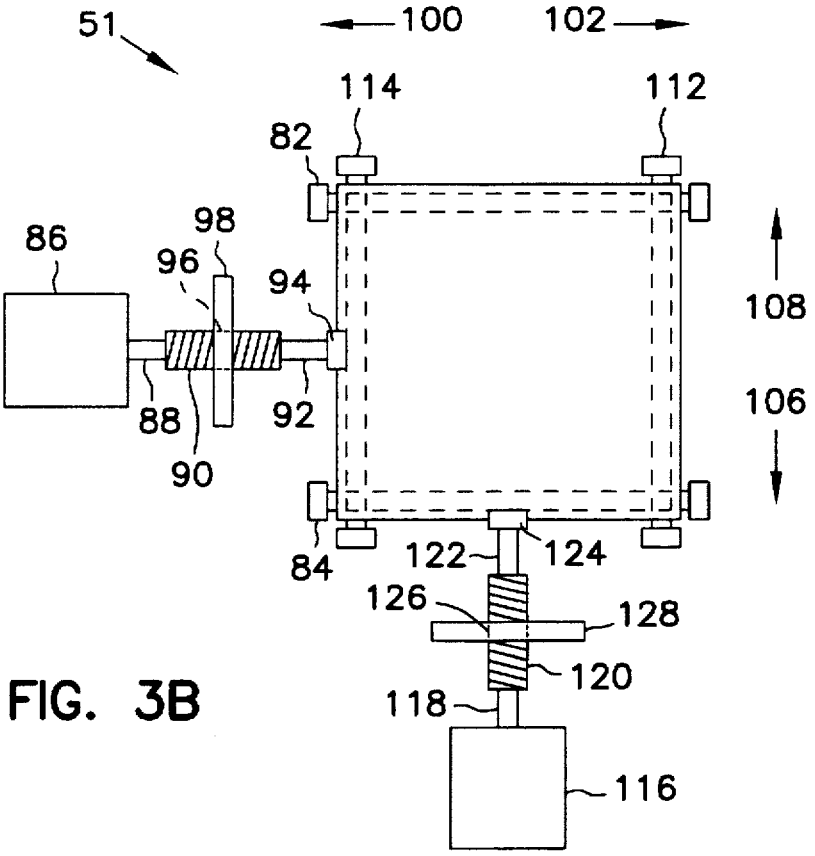
FIG. 3B is a schematic diagram illustrating a print head array according to the present invention with corresponding horizontal and vertical movement mechanisms to move the print head array in both vertical and horizontal dimensions.

FIG. 3B illustrates in schematic diagram form a top view of a print head array 51 according to the present invention. Print head array 51 is used in some forms of the present invention where both small horizontal dimension and small vertical dimension movements of the print head array are performed over a stationary sheet of paper. Print head array 50 rides on horizontal guiderails 82 and 84 and vertical guiderails 112 and 114. Guiderails 82, 84, 112, and 114 preferably include rollers for ease of movement on the guiderails. Guiderails 82, 84, 112, and 114 are supported in any known manner to support the weight of print head array 51. The operation of motor 86 and the shaft system comprising shafts 88, 90, and 92 to move print head array 51 in the horizontal dimension is similar to that described above for the same numbered elements of print head array 50 illustrated in FIG. 3A. However, the mechanical coupling 94 of print head array 50 is replaced with a mechanical coupling 104 to enable movement in the vertical dimension indicated by arrows 106 and 108.

Print head array 51 includes a vertical dimension movement mechanism which operates in a similar manner to the horizontal dimension movement mechanism to provide movement in the vertically dimension as indicated by arrows 106 and 108. A motor 116 drives a shaft 118. Shaft 118 is attached to a threaded shaft 120. Threaded shaft 120 is attached to a shaft 122. Shaft 122 is coupled through a mechanical coupling 124 to print head array 50. Threaded shaft 120 is threadedly mounted within an opening 126 defined within a support plate 128.

Thus, in the configuration illustrated in FIG. 3B, print head array 51 is movably mounted on guiderails 82 and 84 for horizontal dimension movement, indicated by arrows 100 and 102, and on guiderails 112 and 114 for vertical dimension movement, indicated by arrows 106 and 108. Mechanical coupling 104 removes the rotational movement of the shaft system including shafts 88, 90, and 92 to translate directly the horizontal movement into movements of print head array 51. Similarly, mechanical coupling 124 removes the rotational movement of the shaft system including shafts 118, 120, and 122 to translate directly the vertical movement into movements of print head array 51.

Typically, when motor 86 drives the horizontal shaft system in a counter-clock-wise direction, threaded shaft 90 is threaded out of opening 96 to correspondingly move print head array 51 towards motor 86 in a negative horizontal movement, as indicated by arrow 100. When motor 86 drives the horizontal shaft system in a clock-wise direction, the threaded shaft 90 is threaded into threaded opening 96 to correspondingly move print head array 51 away from motor 86 in a positive horizontal movement, as indicated by arrow 102. Similarly, when motor 116 drives the vertical shaft system in a counter-clock-wise direction, threaded shaft 120 is threaded out of opening 126 to correspondingly move print head array 51 towards motor 116 in a negative vertical movement, as indicated by arrow 106. When motor 116 drives the vertical shaft system in a clock-wise direction, the threaded shaft 120 is threaded into threaded opening 126 to correspondingly move print head array 51 away from motor 116 in a positive vertical movement, as indicated by arrow 108.

Print Head Array Configurations

Figure 4A:
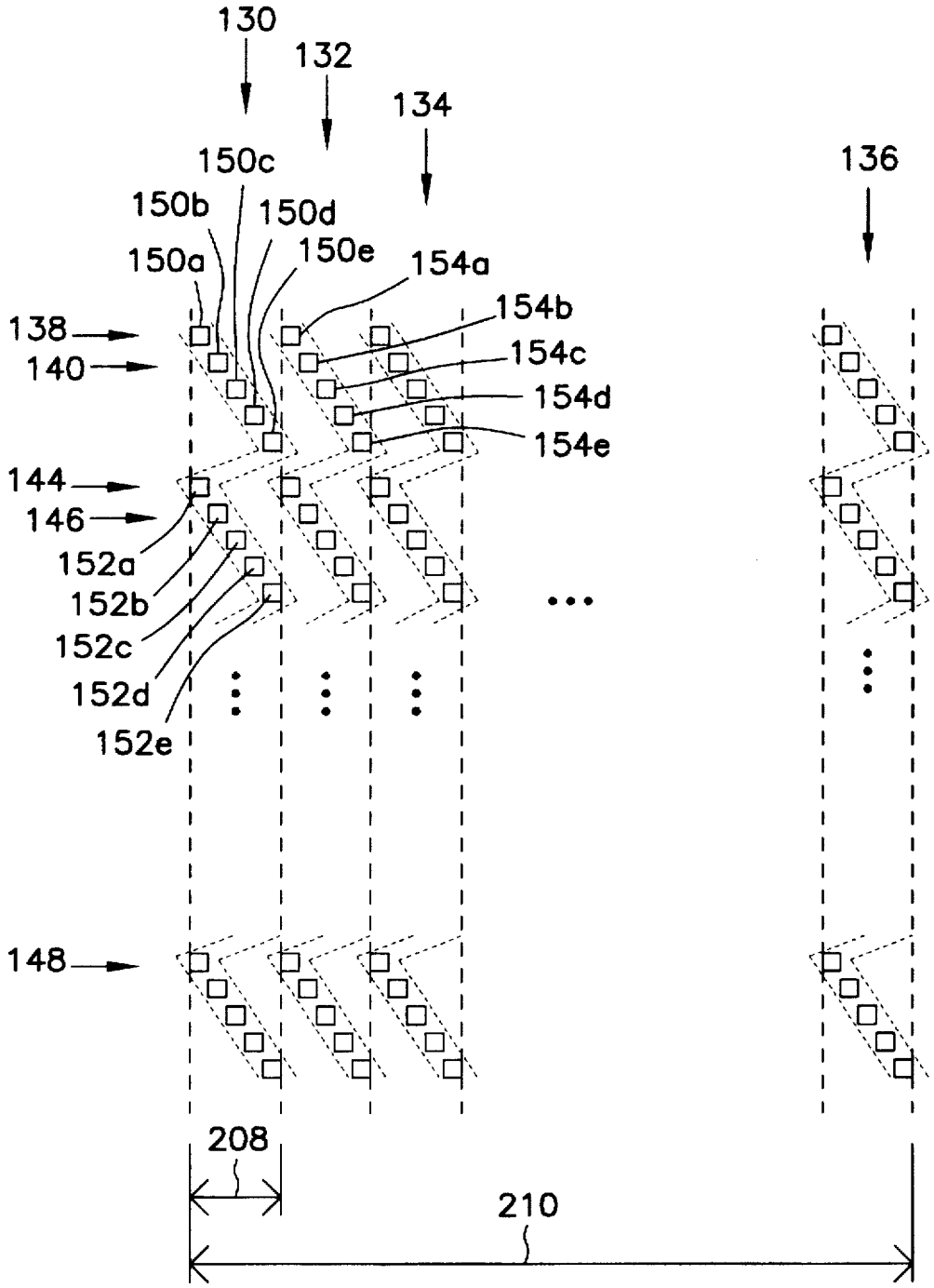
FIG. 4A is a diagram illustrating the organization of print heads in a print head array according to the present invention.
Figure 4B:
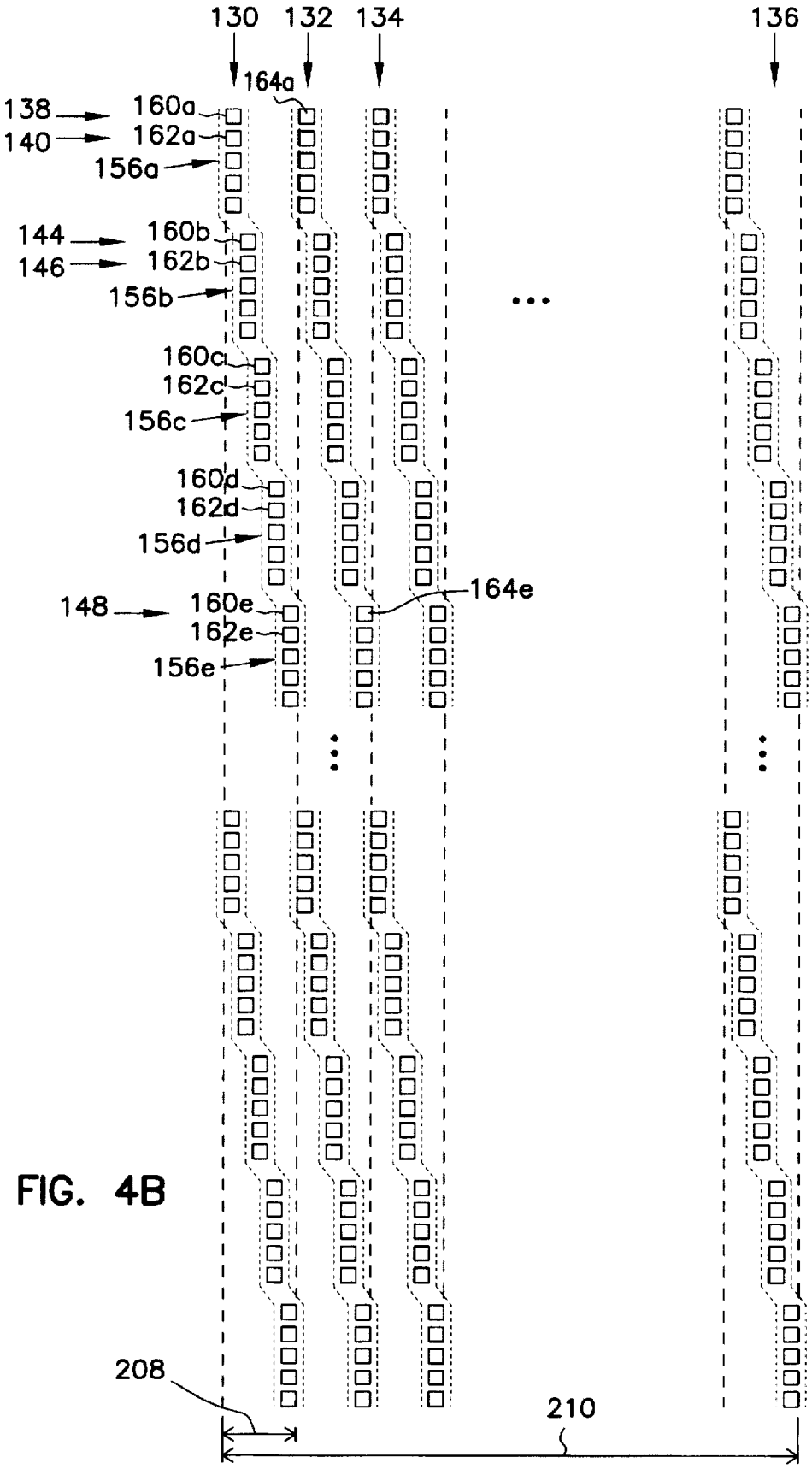
FIG. 4B is a diagram illustrating another preferred organization of print heads in a print head array according to the present invention.
Figure 4C:
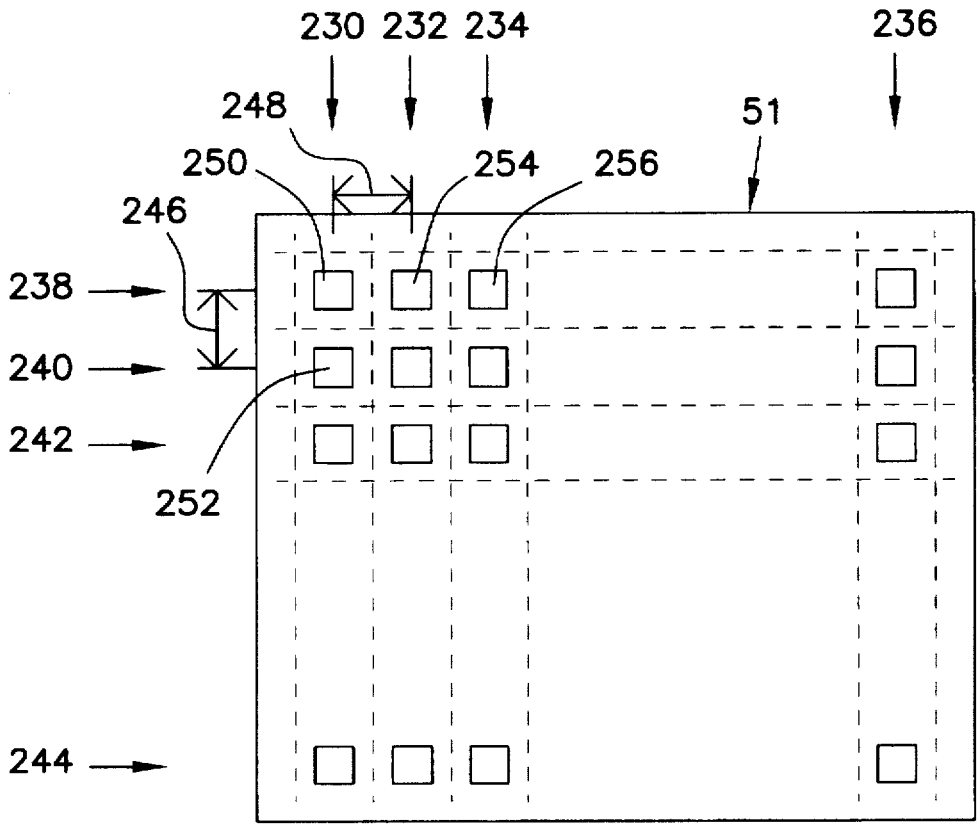
FIG. 4C is a diagram illustrating another preferred organization of print heads in another embodiment of a print head array according to the present invention.

FIGS. 4A–4B illustrate two preferred embodiments of print head array 50 according to two of a variety of print head array configurations according to the present invention. FIG. 4C illustrates a preferred embodiment of print head 51 according to one of a variety of print head configurations according to the present invention. An image 200 printed on a printing medium 202 corresponding to an image printable by the print head array 50 configurations illustrated in FIGS. 4A and 4B is illustrated graphically in FIGS. 5A and 5B. The print head array 51 arrangement illustrated in FIG. 4C prints an image corresponding to an image 300 on a printing medium 302, as graphically illustrated in FIG. 5C.

Figure 5C:
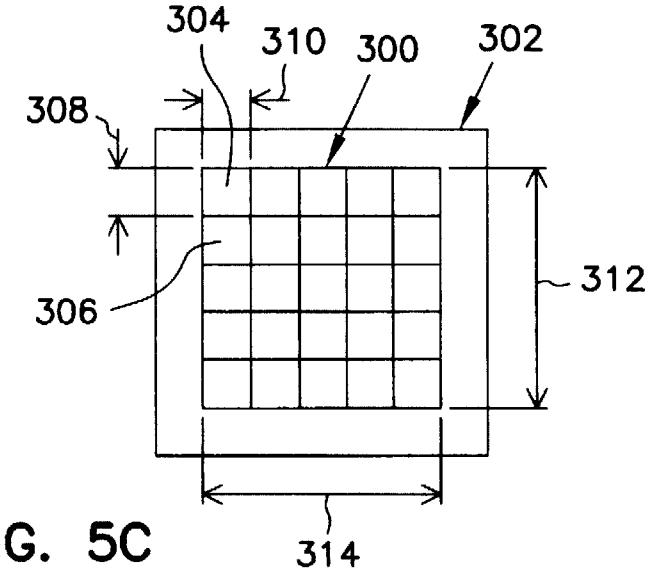
FIG. 5C is a diagram graphically illustrating an image printed with a print head array according to the present invention such as illustrated in FIG. 4C.
Figure 5A:
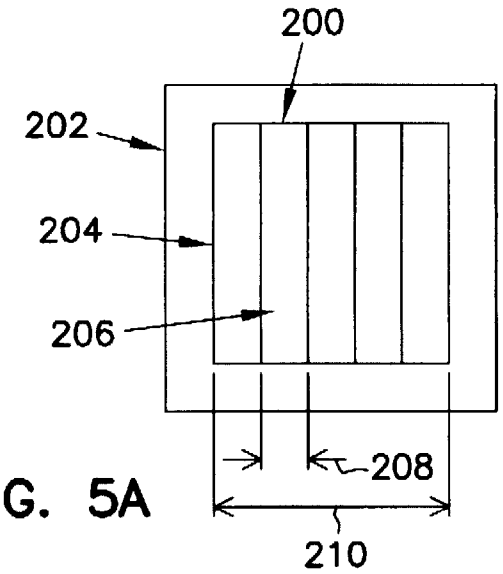
FIG. 5A is a diagram graphically illustrating an image printed with a print head array according to the present invention such as illustrated in FIGS. 4A–4B.

Referring to FIG. 4A, print heads are arranged in this embodiment of print head array 50 in columns such as indicated at 130, 132, 134, and 136, and in corresponding rows as indicated at 138, 140, 144, 146, and 148 to print the corresponding image 200 illustrated in FIG. 5A. Each of the columns in the print head array include a plurality of print heads such as print heads **150*a*–150*e* and print heads 152*a*–152*e* for printing in corresponding printable column areas of the printing medium 202, such as printable column areas 204 and 206 illustrated in FIG. 5A. Each column area has a definable printable column width such as the width of a printable column area 204 indicated by arrows 208 in FIGS. 5A and 4A. The multiple columns of print heads, such as indicated at 130, 132, 134, and 136, are arranged for printing throughout a defined image width 210 of image 200** as indicated in FIGS. 5A and 4A.

Figure 5B:
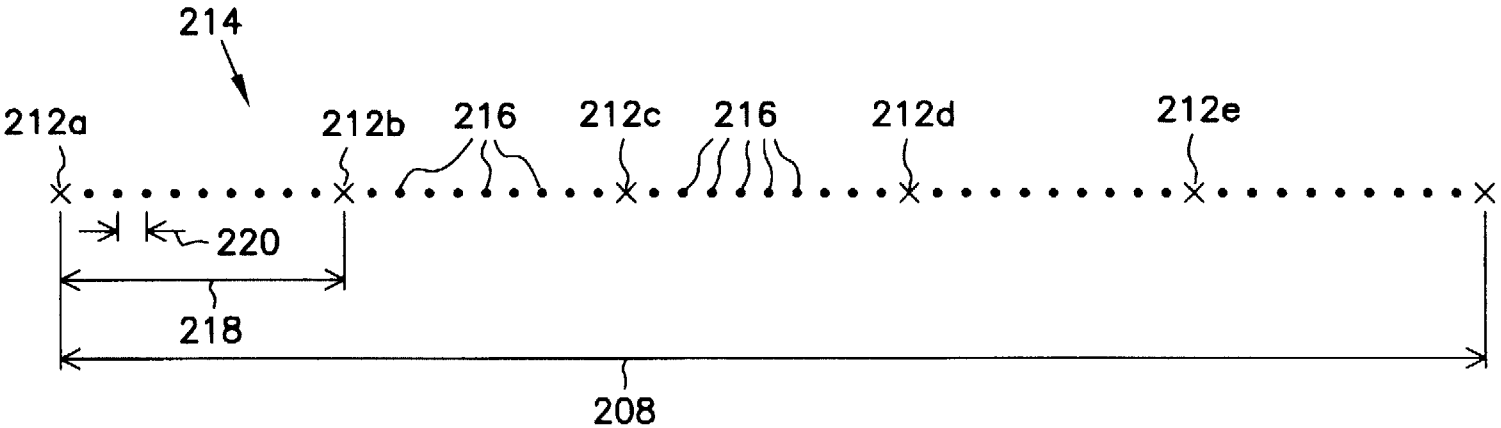
FIG. 5B is a diagram graphically illustrating the placement of dots in a defined printable segment of an image printed with a print head array according to the present invention such as illustrated in FIGS. 4A–4B.

Vertical movement of the paper relative to the print header array, such as the vertical movement produced by the roller and motor system illustrated in FIG. 1, causes a group of print heads from a column of print heads, such as the group of print heads **150*a*–150*e*, to print selected non-contiguous portions, such as indicated at 212*a*–212*e* in FIG. 5B, of a defined printable segment, such as indicated at 214 in FIG. 5B, along the horizontal dimension. Multiple defined printable segments 214 together form a printable column area, such as indicated at 204 and 206. The printable area between each non-contiguous portion 212 is filled in with horizontal movements of print head array 50 via the motor and horizontal shaft system illustrated in FIG. 3A or other suitable movement systems. In FIG. 5B, dots 216 represent an example of the dots filled in by horizontal movement of the print head array between the non-contiguous portions 212***b* and 212*c*. Thus, printable segment 214 is formed with both the vertical movements of the printing medium underneath print head array 50 and the small horizontal movements of print head array 50.

If the printing medium is moving in the positive vertical direction, indicated by arrows 108 in FIGS. 3A and 3B, print head 150*e* prints the non-contiguous portion 212*e* and its corresponding dots created with horizontal movement of print head array 50 in a first vertical position of the printing medium 202. In a next vertical position of the printing medium 202, print head 150*d* prints non-contiguous portion 212*d* and its corresponding dots created with horizontally movement of the print head array. Likewise, print head 150*c* prints non-contiguous portion 212*c* in a next succeeding vertical position of the printing medium 202 and its corresponding dots created with horizonal movement of the print head array. In a next succeeding vertical position of the print medium 202, print head 150*b* prints non-contiguous portion 212*b* and its corresponding dots 216 created with the horizontal movement of the print head array. In the next vertical position of the printing medium 202, print head 150*a* prints non-contiguous portion 212*a* along with its corresponding dots created with horizontal movement of the print head array to complete the horizontal printable segment 214 in column area 204 of image 200.

Multiple printable segments 214 are printed through further vertical movement of the printing medium 202 to fill the corresponding column areas to thereby fill the corresponding portions of image 200. Thus, print heads 152*a*–152*e* are also used to print other printable segments to fill in missing portions of column area 204 of image 200. Correspondingly print heads 154–154*e* are used to filled in portions of column area 206 of image 200. In this way, the combined print head groups print corresponding printable segments to fill all of the column areas of image 200. Alternatively, the printable segments may be distributed to other rows of print heads over the length of the array. Thus, the printable segments do not need to be in adjacent rows.

In the diagram illustrated in FIG. 5B, each printable segment is represented for illustrative purposes as being 50 dots wide as indicated by the column width indicating arrows 208. Horizontal movement of print head array 50 passes through a distance between two consecutive non-contiguous portions, represented for illustrative purposes as being ten dots, such as a distance indicated by arrows 218 between portions 212*a* and 212*b*. A distance between two consecutive dots created by horizontal movement of print head array 50 is indicated by arrows 220. The horizontal movement of print head array 50 needs to be no greater than the widest distance between any two consecutive non-contiguous portions of any printable segment 214. By arranging the columns of print heads across a defined image width of the image, indicated by arrows 210, minus the distance between two non-contiguous portions, indicated at 218, the print heads of print head array 50 are capable of printing throughout the defmed image width 210 of image 200.

There are many suitable arrangements for printing the image 200 graphically illustrated in FIGS. 5A and FIG. 5B. For example, FIG. 4B illustrates another configuration of print head array 50 for printing image 200. As in the configuration illustrated in FIG. 4A, print heads in the configuration illustrated in FIG. 4B are arranged in this embodiment of print head array 50 in columns such as indicated at 130, 132, 134, and 136, and in corresponding rows as indicated at 138, 140, 144, 146, and 148 to print the corresponding image 200 illustrated in FIG. 5A. However, in FIG. 4B, print heads are staggered in vertically aligned sections, such as vertically aligned sections 156*a*–156*e*, which are each separated in the horizontal dimension by the horizontal distance indicated at 218 in FIG. 5B. Each of the vertically aligned sections 156 comprise five print heads. In this way, the print heads from five of the vertically aligned sections, such as print heads 160*a*–160*e* are used to print a printable segment 214.

Referring to FIG. 4B, each of the columns in the print head array include a plurality of print heads such as print heads 160*a*–160*e* and print heads 162*a*–162*e* for printing in corresponding printable column areas of the printing medium 202, such as printable column areas 204 and 206 illustrated in FIG. 5A. Each column area has a definable printable column width such as the width of a printable column area 204 indicated by arrows 208 in FIGS. 5A and 4B. The multiple columns of print heads, such as indicated at 130, 132, 134, and 136, are arranged for printing throughout a defined image width 210 of image 200 as indicated in FIGS. 5A and 4B.

Vertical movement of the paper relative to the print head array, such as the vertical movement produced by the roller and motor system illustrated in FIG. 1, causes a group of print heads from a column of print heads, such as the group of print heads 160*a*–160*e*, to print selected non-contiguous portions, such as indicated at 212*a*–212*e* in FIG. 5B, of the defined printable segment 214 indicated in FIG. 5B, along the horizontal dimension. Multiple defined printable segments 214 together form a printable column area, such as indicated at 204 and 206. The printable area between each non-contiguous portion 212 is filled in with horizontal movements of print head array 50 via the motor and horizontal shaft system illustrated in FIG. 3A or other suitable movement systems. In FIG. 5B, dots 216 represent an example of the dots filled in by horizontal movement of the print head array between the non-contiguous portions 212*b* and 212*c*. Thus, printable segment 214 is formed with both the vertical movements of the printing medium underneath print head array 50 and the small horizontal movements of print head array 50.

If the printing medium is moving in the positive vertical direction, indicated by arrows 108 in FIGS. 3A and 3B, print head 160*e* prints the non-contiguous portion 212*e* and its corresponding dots created with horizontal movement of print head array 50 in a first vertical position of the printing medium 202. In a next vertical position of the printing medium 202, print head 160*d* prints non-contiguous portion 212*d* and its corresponding dots created with horizontally movement of the print head array. Likewise, print head 160*c* prints non-contiguous portion 212*c* in a next succeeding vertical position of the printing medium 202 and its corresponding dots created with horizonal movement of the print head array. In a next succeeding vertical position of the print medium 202, print head 160*b* prints non-contiguous portion 212*b* and its corresponding dots 216 created with the horizontal movement of the print head array. In the next vertical position of the printing medium 202, print head 160*a* prints non-contiguous portion 212*a* along with its corresponding dots created with horizontal movement of the print head array to complete the horizontal printable segment 214 in column area 204 of image 200.

Multiple printable segments 214 are printed through further vertical movement of the printing medium 202 to fill the corresponding column areas to thereby fill the corresponding portions of image 200. Thus, print heads 162a–162e are also used to print other printable segments to fill in missing portions of column area 204 of image 200. Correspondingly print heads 164–164e are used to filled in portions of column area 206 of image 200. In this way, the combined print head groups print corresponding printable segments to fill all of the column areas of image 200.

The printing array configurations of FIG. 4A or 4B for the two illustrated embodiments of print head array 50 take advantage of the fact that one horizontal segment is printed with print heads having varying vertical positions via the vertical movement of the printing medium relative to the print heads and the short horizontal movements of the print head array relative to the printing medium. The horizontal movement is a relative movement, just as with the relative vertical movement, and therefore, may optionally be accomplished by moving the paper in short horizontal movements instead of moving the print head array itself, or both.

In several embodiments of the present invention where the print elements of print head arrays 50 and 51 move at sufficiently high speed, the printing medium can move continuously relative to the print head array in the vertical dimension and the print head array can move continuously relative to the printing medium in the horizontal dimension. If the print elements move fast enough it is as if the printing medium and print head array are stopped momentarily. The maximum speed at which the printing medium and the print head array are moved is dependent on the speed of the print elements in the print head array. For example, electro-mechanical print elements in the print head array must move fast enough that the pin does not smear ink on the printing medium as it moves relative to the print head array. If smearing occurs, the print elements must be made to move faster, or the printing medium must be slowed down, or the horizontal movement of the print head array must be slowed down, or some combination of these actions must take place.

FIG. 4C illustrates a preferred configuration of print head array 51 according to the present invention. Print head array 51 is arranged in columns, such as indicated at 230, 232, 234, and 236, and rows, such as indicated at 238, 240, 242, and 244. Typically, print head array 51 operates on a stationary sheet of paper or printing medium such as indicated at 302 to print an image 300, graphically illustrated in FIG. 5C. Since print head array 51 does not typically have paper moving vertically underneath it, the horizontal motor and shaft movement system needs to be combined with the vertical motor and shaft movement system, such as illustrated in FIG. 3B and described above.

Each print head in a column in print head array 51 is separated from the next consecutive print head by a vertical distance, as indicated by arrows 246 representing the distance between print heads 250 and 252 located in column 230. Likewise, a horizontal distance, as indicated by arrows 248, separates two consecutive print heads in a row of print heads, such as the distance between print heads 254 and 256 located in row 238.

Each print head in print head array 51 is assigned a corresponding printable area such as printable area 304 or printable area 306 indicated in FIG. 5C. Each printable area includes a corresponding vertical length 308 and horizontal width 310. The combined vertical lengths of all the corresponding printable areas are equal to the image length indicated at 312. The combined horizontal widths of all the printable areas are equal to the image width 314.

Therefore, if the printing medium is not moved vertically underneath print head 51, the arrangement of print head array 51 requires vertical movements at least equal to the distance indicated by arrows 308 of the greatest vertical length of any printable area of image 300, and horizontal movements at least equal to the distance indicated by arrows 310 of the greatest horizontal width of any printable area of image 300. For example, in a typical embodiment using this arrangement of print head array 51, 1/16 inch movements in both the vertical and horizontal dimensions are utilized with prints heads each having one printing element separated by 1/16 of an inch. If the printing medium is not moved vertically underneath print head 51, the print head array needs to cover the entire printable image area or be moved accordingly in large movements to cover separate sub-images of a larger image.

Print head array 51, however, is alternatively utilized in a printing system according to the present invention wherein the printing medium is moved vertically underneath the print head array, as described above in reference to print head array 50, to take advantage of the vertical movement of the printing medium to allow each print head to print multiple corresponding printable areas, such as printable area 304 or printable area 306 indicated in FIG. 5C. Likewise, the configurations of print head array 50 illustrated in FIGS. 4A and 4B are alternatively utilized in a printing system according to the present invention wherein the printing medium is stationary, as described above in reference to print head array 51. If the printing medium is not moved underneath print head array 50, the horizontal motor and shaft movement system needs to be combined with the vertical motor and shaft movement system, such as illustrated in FIG. 3B and described above, to permit each print head to print a corresponding printable area of the image.

In addition, since the print heads of any of the print head arrays according to the present invention are preferably controlled by a computer operating according to a software program, the print heads can be organized in the print head array in non-uniform configurations which can be compensated for with the software program. Thus, there are numerous configurations of a print head array according to the present invention which can be operated as described above to print on a printing medium moving underneath the print head array or on a stationary printing medium.

Single element print heads or multiple element print heads can be used in any of the print head arrays according to the present invention to print single dots or multiple dots respectfully with one activation of the print head. There are numerous types of suitable print heads which can be used in the print head array, with each type having distinct advantages and disadvantages. For example, the conventional electro-mechanical actuator impact print head or conventional ink-jet print head described in the background section could be used in the above described array structure. However, as discussed below these conventional type print heads severely limit the performance of the print head array according to the present invention. Various preferred types of prints heads according to the present invention and a preferred convention bubble-jet print head for use in the print head array according to the present invention are described below.

Electro-mechanical Actuator Print Head Embodiments

Figure 6A:
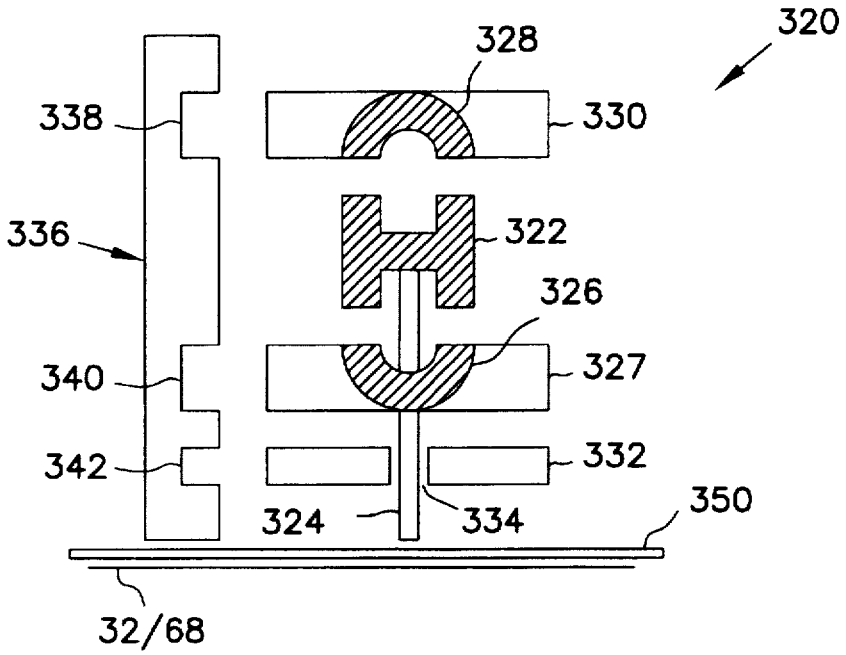
FIG. 6A illustrates a dot matrix electro-mechanical actuator impact print head according to the present invention and the supporting structure of the print head array for holding the print heads in the array according to the present invention.

A preferred embodiment of a electro-mechanical actuator impact print head according to the present invention is generally illustrated at 320 in FIG. 6A. In addition, FIG. 6A illustrates the supporting structure for supporting each print head in a print head array according to the present invention.

Print head array 320 includes a H-Bar electromagnet 322. A pin 324 is fixably mounted into H-Bar electromagnetic 322. Pin 324 is also referred to as a wire, needle, or rod. Pin 324 in a preferred embodiment on the invention described below is a tubular pin. A lower half toroidal shaped electromagnet 326 is mounted in a support 327 below H-Bar electromagnet 322. An upper half toroidal shaped electromagnet 328 is mounted above H-Bar electromagnet 322 in a support 330. An optional guided pin support 332 has a opening defined therein as indicated at 334 to support and guide pin 324. A side support 336 of the print head array includes a notched portion 338 wherein support 330 is fixably mounted therein. Side support 336 also includes notched portions 340 and 342, in which supports 327 and optional guidepin support 332 are respectively fixably mounted.

Each of the supports 327, 330, and 332 are shown for supporting one print head 320 for illustrative purposes only, and actuality support all the print heads of the print head array. Furthermore, other support structures are also possible.

In the embodiment of the electro-mechanical actuator print head illustrated in FIG. 6A, the electro-mechanical actuation of the pin 324 as herein described below, causes pin 324 to strike an ink ribbon 350 disposes between the top printing surface of the printing medium and the actuator pins. In this way, ink from ink ribbon 350 is transferred to the printing medium to create the image on the printing medium.

Figure 6B:
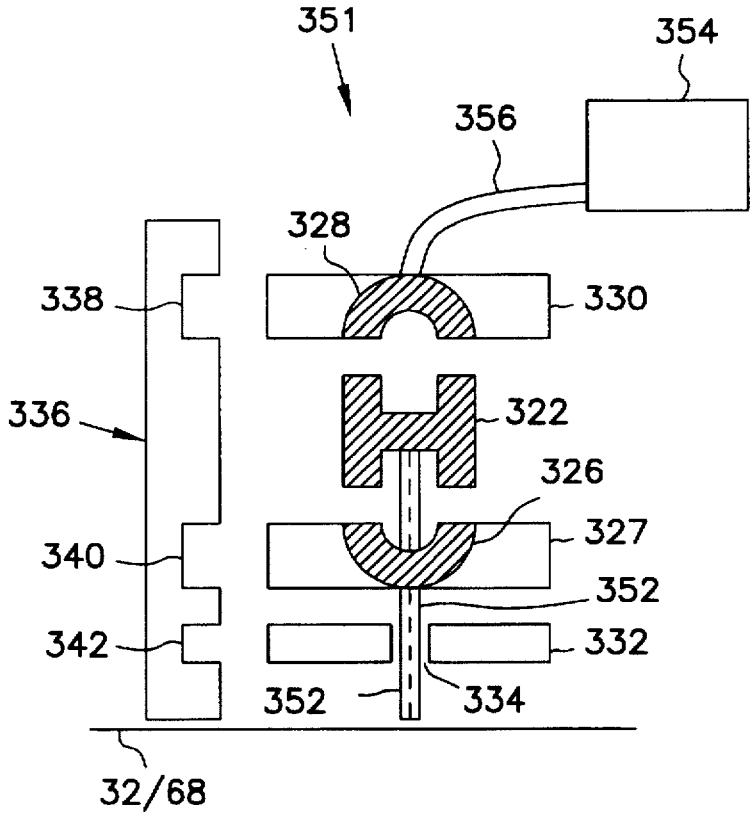
FIG. 6B illustrates a non-impact dot matrix electro-mechanical actuator print head according to the present invention and the corresponding support structure from the print head array according to the present invention.

Another preferred embodiment of the electro-mechanical actuator print head is generally illustrated at 351 in FIG. 6B. Print head 351 comprises a tubular pin 352, which is illustrated and described below in reference to FIGS. 13A–C. An ink well 354 provides a source of ink. A flexible plastic ink tube 356 carries and delivers the ink from ink well 354 to tubular pin 352.

Figure 13A:
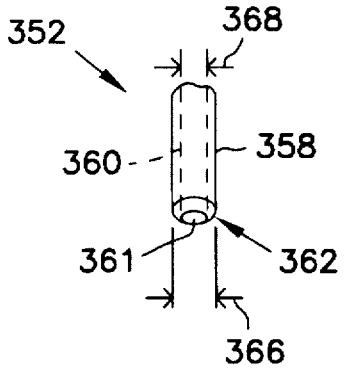
FIGS. 13A–13B are schematic diagrams illustrating a preferred tubular shaped printing element or pin according to the present invention.
Figure 13B:
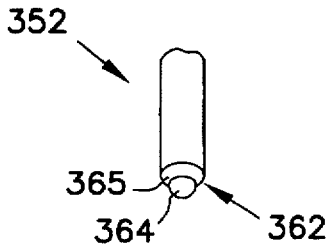

Preferred tubular pin 352 of FIG. 6B is illustrated in schematic diagram form in FIGS. 13A–C. Tubular pin 352 includes an outer tubular shaft portion 358 and the inner hollow tubular portion defined therein 360. The hollow portion 360 runs through an opening 362 in an end 362 of the tubular pin 352. A drop of ink 364 is formed at the end of opening 361. The outer diameter of tubular pin 352 is indicated by arrows 366, while the inner diameter is indicated by arrows 368. The inner diameter of the hollow portion 360 is so small that the surface tension of the ink keeps the ink inside the tubular pin. An outside of the end portion 362 of tubular pin 352 is preferably beveled and coated with a coating 365, such as the conventional coating used on printing plates, to prevent ink from being drawn up from the printing medium.

Tubular pin 352 is preferably made out of a hard material such as stainless steel. In a preferred embodiment of tubular pin 352 for printing at a resolution of 300 dots per inch (d.p.i.), the inner diameter, indicated by arrows 368, is 1/300th of an inch and the outer diameter, indicated by arrows 366 is 1/50th of an inch with a wall thickness of 5/600th of an inch. In a preferred embodiment of tubular pin 352 for printing at a resolution of 1200 dots per inch (d.p.i.), the inner diameter, indicated by arrows 368, is 1/1200th of an inch and the outer diameter, indicated by arrows 366 is 1/50th of an inch with a wall thickness of 11/1200th of an inch. Tubular pin 352 can be similarly constructed for producing other sized dots. One embodiment of the print head array according to the present invention, prints variable dot sizes using print heads with tubular pins for producing 300 d.p.i. and print heads with tubular pins for producing 1200 d.p.i. to achieved a resolution of 1200 d.p.i.

Power Controllers for Controlling Power to the Electromagnets

Figure 8:
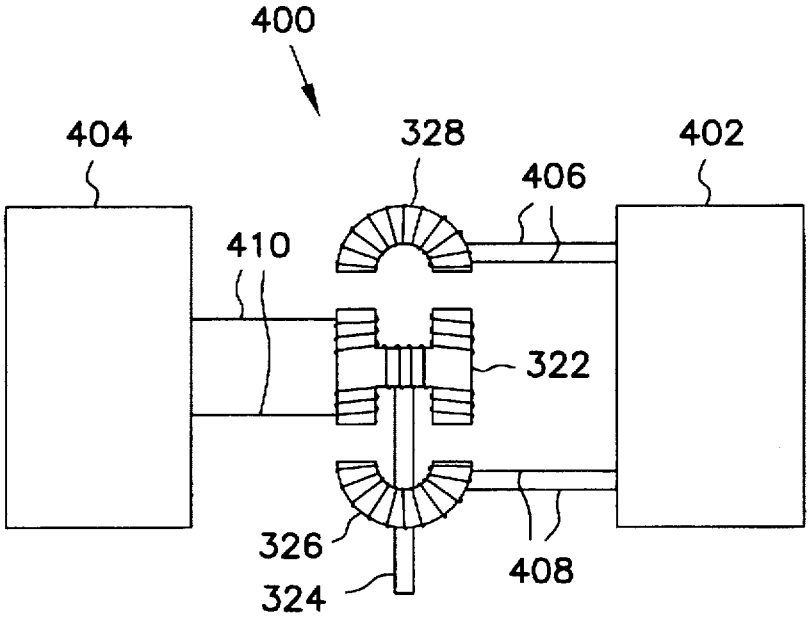
FIG. 8 is a schematic diagram illustrating the electrical power circuitry for the electromagnets contained in the electro-mechanical actuator print heads according to the present invention.

FIG. 8 illustrates the electrical system for powering the electromagnets of the preferred magnetic actuating print head. Power system 400 includes an alternating current (AC) power controller 402 providing power to an insulated electrical conductor 406 which surrounds electromagnet 328. AC power controller 402 also supplies power to an electrical conductor 408 which surrounds electromagnet 326. A DC power controller 404 supplies power to a electrical conductor 410 which surrounds the H-Bar electromagnet 322.

AC power controller 402 preferably controls the current to electrical conductors 406 and 408 to properly energize the electromagnets to the correct plurality to achieve the below described magnetic flux to operate pin 324 between a non-print and print position and a print and a non-position as described below under the control of computer 52. DC power controller 404 preferably creates a constant electromagnetic 322. In this sense, electromagnetic 322 could be replaced with a H-bar permanent magnetic subject to the below described limitations of permanent magnets.

Thoroughfares in Electro-mechanical Actuator Print Head

Figure 9A:
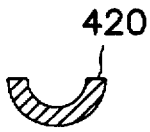
Figure 9B:
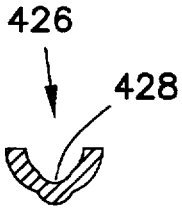
Figure 9C:
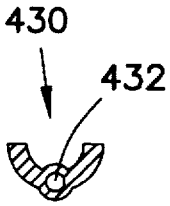

FIG. 9A–9C illustrates various thoroughfares to permit the printing pin such as printing pin 324 or the flexible ink tube 356 around the toroidal shaped electromagnets. For example, in FIG. 9A an ordinary toroid shaped electromagnet 420 requires that the pin be formed around the electromagnet or that the flexible ink tubing be formed around the electromagnet. By contrast, as illustrated FIG. 9B the toroid shaped electromagnet can be formed to have a divot shaped bend 428 to provide a path for the pin and/or the flexible ink tube. FIG. 9C illustrates yet another embodiment of the toroidal shaped electrical magnetic wherein a circular donut shaped hole is defmed within the center portion of the toroid shaped electromagnet 430 as indicated at 432.

Operation of a Preferred Non-Impact Electro-mechanical Actuator Print Head

Referring to FIG. 6B and FIG. 13, tubular pin 352 is preferably mounted on H-bar electromagnet 322, which is driven by half toroid electromagnet 328 mounted above the H-bar electromagnet and half toroid electromagnet 326 mounted below the H-bar electromagnet. Tubular pin is precisely aligned by at least one pin support, such as pin support 334.

Flexible plastic ink tube 356, which delivers ink to tubular pin 352 for transfer to the printing medium is connected to the tubular pin, through a donut shaped hole (such as shown at 432 in FIG. 9C), functioning as a thoroughfare in the crossbar portion of H-bar electromagnet 322. Flexible plastic ink tube ink tube 356 passes through a donut shaped hole (such as shown at 432 in FIG. 9C) in half toroid electromagnet 328 above H-bar electromagnet 322 and is connected at its other end to ink well 354. The inner diameter indicated by arrows 368 of the opening 361 of hollow portion 360 through which the ink flows is so small that the surface tension of the ink keeps the ink inside the tubular pin. Additionally, ink well 354 is optionally pressurized. Only when H-bar electromagnet 322 makes contact with support 327 and/or tubular pin 352 makes contact with the printing medium is a droplet of ink, such ink droplet 364, forced, by its own momentum and/or the ink's adherence to the printing medium, out of tubular pin 352 onto to the printing medium.

Tubular pin 352 is initially at rest in its lower most position with H-bar electromagnet 322 in contact with the support 327. Initially, all three electromagnets 322, 326, and 328 are off. Tubular pin 352 is brought to its uppermost position by turning on the three electromagnets such that half toroid electromagnet 328 above H-bar electromagnet 322 attracts the H-bar electromagnet and half toroid electromagnet 326 below the H-bar electromagnet repels the H-bar electromagnet.

When tubular pin 352 is required to transfer a droplet of ink, such as ink droplet 364, to the printing medium, half toroid electromagnet 326 below H-bar electromagnet 322 is made to change polarity with AC power controller 402 (shown in FIG. 8) under control of computer 52 (shown in FIGS. 1 and 2) to attract the H-bar electromagnet. Simultaneously, half toroid electromagnet 328 above H-bar electromagnet 322 is made to change polarity with AC power controller 402 under control of computer 52 to repel the H-bar electromagnet. The tractive forces of the three electromagnets cause H-bar electromagnet 322 and tubular pin 352 to move to their lowermost position with the H-bar electromagnet in contact with support 327. A droplet of ink, such as ink droplet 364, is transferred from tubular pin 352 when H-bar electromagnet 322 makes contact with support 327 and/or tubular pin 352 makes contact with the printing medium.

H-bar electromagnet 322 and tubular pin 352 are then brought to their uppermost position by reversing the polarity of the half toroid electromagnets 326 and 328 with AC power controller 402 under control of computer 52. Half toroid electromagnet 328 above H-bar electromagnet 322 is made to change polarity with AC power controller 402 under control of computer 52 to attract the H-bar electromagnet. Simultaneously, half toroid electromagnet 326 below H-bar electromagnet 322 is made to change polarity with AC power controller 402 under control of computer 52 to repel the H-bar electromagnet. The polarity of H-bar electromagnet 322 remains constant though the control of DC power controller 404 (shown in FIG. 8). Thus, electromagnetic 322 is optionally replaced with a H-bar permanent magnetic. However, there are some limitations of permanent magnets described below which could limit the performance capability of electro-mechanical actuator print head 351 if the H-bar magnet is permanent.

H-bar electromagnet 322 and lower half toroid electromagnet 326 can be off between cycles and during cycles where tubular actuator pin 352 is not required to print dots. Upper half toroid electromagnet 328 will attract H-bar electromagnet 322 and keep it in the non-print position when the H-bar electromagnet is off. Similarly, if the H-bar electromagnet is a permanent magnet, both the upper and lower half toroid electromagnets 328 and 326 can be off between cycles and during cycles where tubular pin 352 is not required to print dots. This operation generates less heat and requires less electrical power.

In the above described way, electro-mechanical actuator print head 351 can be made to deliver ink onto the printing medium without ever impacting the printing medium. In this sense, print head 351, as a non-impact electro-mechanical actuator print head, differs significantly from other conventional impact electro-mechanical actuator print heads. Of course, electro-mechanical actuator print head 351 could also be implemented to delivery ink upon impact with the printing medium as described above.

The above described actuator operation of electromagnets 322, 326, and 328 of print head 351 to move tubular pin 352 from its non-print position to its print position and from its print position to its non-print position is similar to the action required of electromagnets 322, 326, and 328 of print head 320 to move solid pin 324 from its non-print position to its print position striking the ink ribbon 350 and from its print position to its non-print position.

Cooling System

Figure 10:
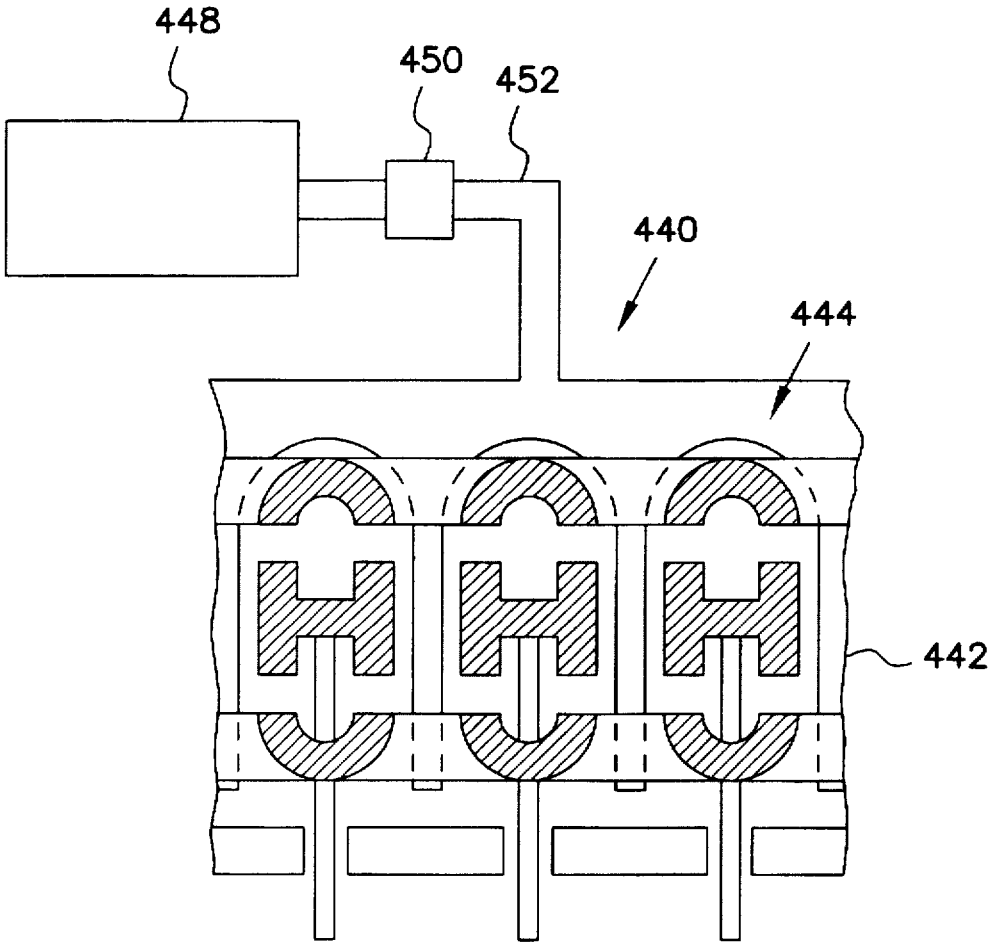
FIG. 10 is schematic diagram of a cooling system for cooling the electro-mechanical actuator print heads in the print head array according to the present invention.

A cooling system for cooling the electro-mechanical actuator print heads of the print head array according to the present invention, such as electro-mechanical actuator print heads 320 and 351, is generally indicated at 440 in FIG. 10. A coolant jacket 442 defines a cavity 444 which holds a refrigerant 446 which substantially covers at least the sides of the electromagnets of the electro-mechanical actuator print heads. A conventional cooling device 448 stores refrigerant 446 and cools the refrigerant which is heated by the electromagnets of the electro-mechanical actuator print heads of the print head array. Refrigerant 446 is circulated from and to cooling device 448 with a pump 450 though a pipe 452 coupled to cooling jacket 442 to effectively cool the electromagnets to a temperature below (1) the melting point for any of the components of the electro-mechanical actuator print heads substantially exposed to the heat generated by the electromagnets, including the electromagnets themselves; and (2) if permanent magnets are comprised in the actuating print heads, below the Curie temperature of the permanent magnets (the point at which the permanent magnet will lose its magnetism).

If no cooling system, such as cooling system 440 is used, the typical electro-mechanical actuator print head requires a substantial reduced duty cycle, such as a 25% duty cycle. If the above described cooling system 440 is employed in the printing system according to the present invention, the duty cycle can be increased to a 100% duty cycle, if necessary. Of course, the electromagnets of the electro-mechanical actuator print head can also be cooled less effectively, but less expensively, with some type of conventional air cooling device to somewhat increase the duty cycle.

Other Structures of the Electro-mechanical Actuator Head

Figure 7A:
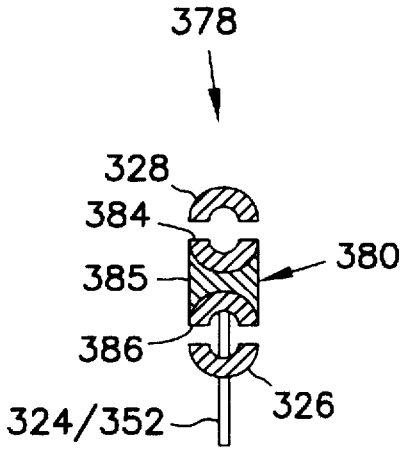
FIGS. 7A–7B illustrates variations of the preferred form of the electro-mechanical actuator print head according to the present invention.
Figure 7B:
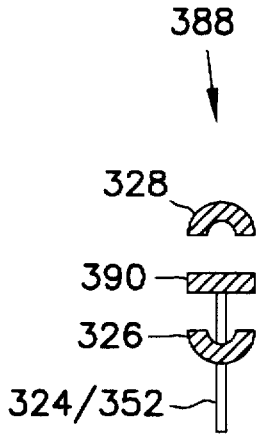

The present invention is not limited to the structure of the magnetic actuator head illustrated in FIG. 6A and 6B, rather there are many variations which are encompassed by the present invention. For example, FIG. 7A and 7B illustrate other preferred embodiments of the mechanical actuator print head according to the present invention. In FIG. 7A, an electro-mechanical actuator head 378 has the H-Bar electromagnet 322 of electro-mechanical head 320 functionally replaced by another electromagnet structure 380. In the embodiment, a half toroidal shaped electromagnet 384 is mounted on a support 385 to face the upper half toroid shaped electromagnet 328. A corresponding half toroidal shaped electromagnet 386 is mounted on support 385 to face the lower half toroid shaped electromagnet 326. FIG. 7B illustrates a somewhat simplified version of a preferred toroidal shaped magnetic actuator head 388. Mechanical actuator head 388 comprises a rectangular shaped electromagnet 390 to functionally replace the H-Bar shaped electromagnet 322 of electro-mechanical actuator head 320. Rectangular shaped electromagnet 390 is directly attached to the pin 324.

Other simpler and lighter weight, but less efficient embodiments of the mechanical actuator head magnet structure are illustrated in FIGS. 11A–F. These structures completely eliminate the H-Bar structure 322 and have the pin 324 attached to one of the electromagnets.

Figure 11A:
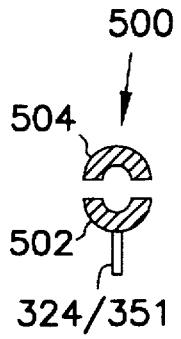
FIGS. 11A–11H illustrate various structural forms of the electro-mechanical actuator print head according to the present invention.

For example, FIG. 11A illustrates an electro-mechanical actuator print head 500 which includes a lower half toroidal shaped electromagnet 502 and an upper half toroidal shaped electromagnet 504 which face each other. Lower half toroid electromagnet 502 is fixably attached to a pin, such as solid pin 324 or tubular pin 351 described above in reference to FIGS. 6A and 6B respectfully. One of the half toroid electromagnets 502 and 504 is made to change polarity with AC power controller 402 under control of computer 52 to cause the two half toroidal magnets to repel each other through repulsive magnetic forces to drive the pin toward the printing medium to a printing position. The one of half toroid electromagnets 502 and 504 is again made to change polarity with AC power controller 402 under control of computer 52 to cause the two half toroidal magnets to attract each other through attractive magnetic forces to drive the pin from the printing medium to a non-print positions.

Figure 11B:
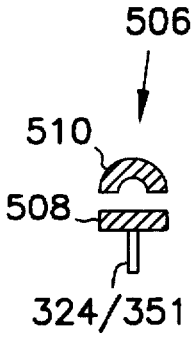
Figure 11C:
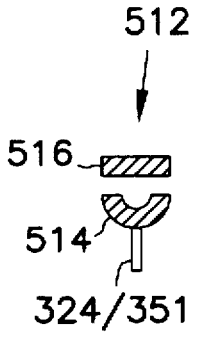

Other electro-mechanical actuator print heads illustrated in FIGS. 11A–11F operate similar to the above described operation of electro-mechanical actuator print head 500. FIG. 11B illustrates an electro-mechanical actuator print head 506 which includes a lower rectangular shaped electromagnet 508 and an upper half toroidal shaped electromagnet 510. Lower rectangular electromagnet 508 is fixably attached to a pin, such as solid pin 324 or tubular pin 351. FIG. 11C illustrates an electro-mechanical actuator print head 512 which includes a lower half toroidal shaped electromagnet 514 and an upper rectangular shaped electromagnet 516. Lower half toroid electromagnet 514 is fixably attached to a pin, such as solid pin 324 or tubular pin 351.

Figure 11D:
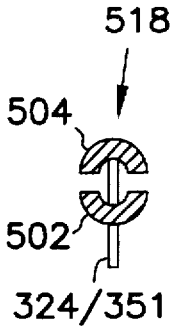
Figure 11E:
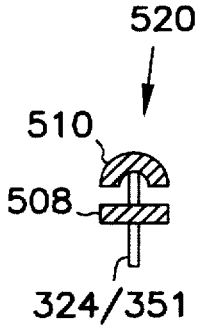
Figure 11F:
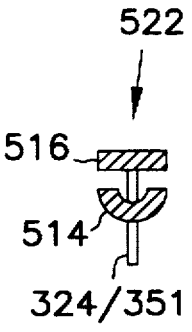

FIG. 11D illustrates an electro-mechanical actuator print head 518 similar to electro-mechanical actuator print head 500, except that upper half toroid electromagnet 504 is fixably attached to the pin, such as solid pin 324 or tubular pin 351, instead of lower half toroid electromagnet 502. FIG. 11E illustrates an electro-mechanical actuator print head 520 similar to electro-mechanical actuator print head 506, except that upper half toroid electromagnet 510 is fixably attached to the pin, such as solid pin 324 or tubular pin 351, instead of lower rectangular electromagnet 508. FIG. 11F illustrates an electro-mechanical actuator print head 522 similar to electro-mechanical actuator print head 512, except that upper rectangular electromagnet 516 is fixably attached to the pin, such as solid pin 324 or tubular pin 351, instead of lower half toroid electromagnet 514.

Solenoid Structures of the Electro-mechanical Actuator Head

Figure 11G:
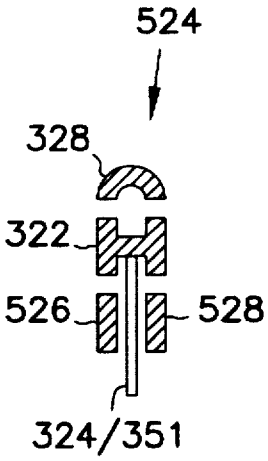
Figure 11H:
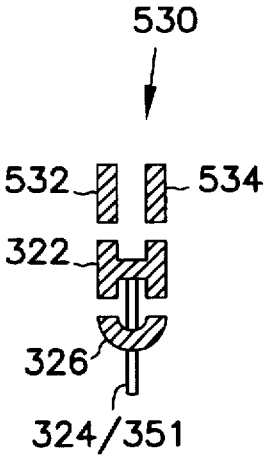

The preferred toroidal shaped electromagnets can be replaced with solenoid type electromagnets subject to the limitations of the solenoid electromagnets described below for electro-mechanical actuator print heads operating like the preferred print heads illustrated in FIGS. 6A–B and FIGS. 7A–B, or for the electro-mechanical actuator print heads operating like the print heads illustrated in FIGS. 11A–F. For example, FIG. 11G illustrates an electro-mechanical actuator print head 524 similar to electro-mechanical actuator print heads 320 or 351, except that the lower half toroid electromagnet 326 is replaced with two solenoids 526 and 528. FIG. 11H illustrates an electro-mechanical actuator print head 530 similar to electro-mechanical actuator print heads 320 or 351, except that the upper half toroid electromagnet 328 is replaced with two solenoids 532 and 534.

Figure 12A:
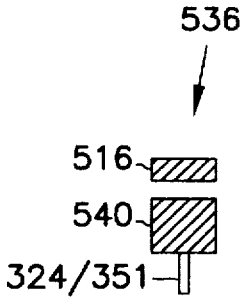
FIGS. 12A–12K illustrates various structures of solenoid type electro-mechanical actuator print heads according to the present invention.
Figure 12B:
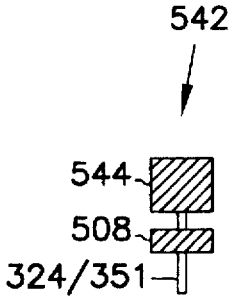
Figure 12C:
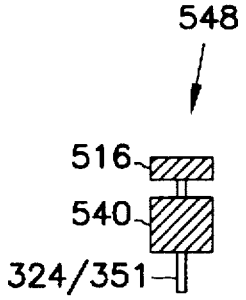
Figure 12D:
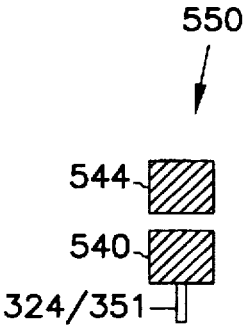
Figure 12E:
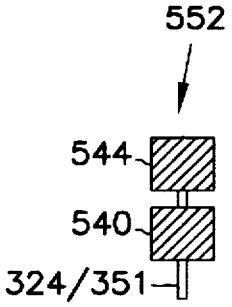

FIG. 12A illustrates an electro-mechanical actuator print head 536 similar to electro-mechanical actuator print head 512, except that the lower half toroid electromagnet 514 is replaced with a solenoid 540. FIG. 12B illustrates an electro-mechanical actuator print head 542 similar to electro-mechanical actuator print head 520, except that the upper half toroid electromagnet 510 is replaced with a solenoid 544. FIG. 12C illustrates an electro-mechanical actuator print head 548 similar to electro-mechanical actuator print head 522, except that the lower half toroid electromagnet 514 is replaced with solenoid 540. FIG. 12D illustrates an electro-mechanical actuator print head 550 similar to electro-mechanical actuator print head 500, except that the lower half toroid electromagnet 502 is replaced with solenoid 540, and the upper half toroid electromagnet 504 is replaced with solenoid 544. FIG. 12E illustrates an electro-mechanical actuator print head 552 similar to electro-mechanical actuator print head 518, except that the lower half toroid electromagnet 502 is replaced with solenoid 540, and the upper half toroid electromagnet 504 is replaced with solenoid 544.

Figure 12F:
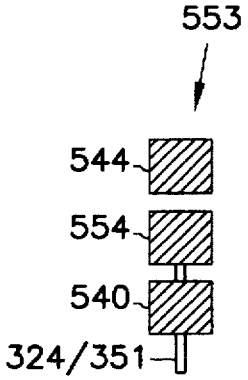
Figure 12G:
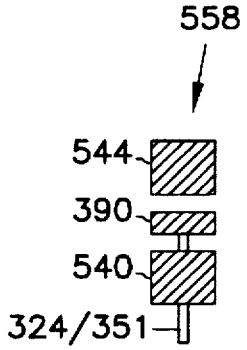

FIG. 12F illustrates an electro-mechanical actuator print head 553 similar to electro-mechanical actuator print head 378, except that the lower half toroid electromagnet 326 is replaced with solenoid 540, the upper half toroid electromagnet 328 is replaced with solenoid 544, and center half toroid electromagnetic structure 380 is replaced with solenoid 554. FIG. 12G illustrates an electro-mechanical actuator print head 558 similar to electro-mechanical actuator print head 388, except that the lower half toroid electromagnet 326 is replaced with solenoid 540, and the upper half toroid electromagnet 328 is replaced with solenoid 544.

Figure 12H:
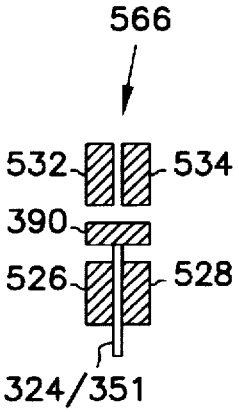
Figure 12I:
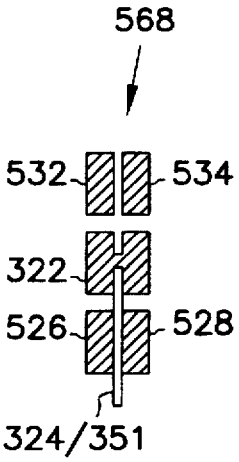
Figure 12J:
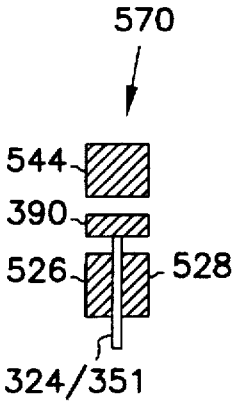
Figure 12K:
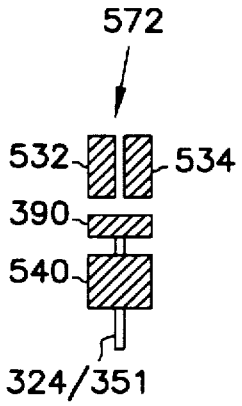

FIG. 12H illustrates an electro-mechanical actuator print head 566 similar to electro-mechanical actuator print head 388, except that the lower half toroid electromagnet 326 is replaced with two solenoids 526 and 528, and the upper half toroid electromagnet 328 is replaced with two solenoids 532 and 534. FIG. 12I illustrates an electro-mechanical actuator print head 568 similar to electro-mechanical actuator print heads 320 or 351, except that the lower half toroid electromagnet 326 is replaced with two solenoids 526 and 528, and the upper half toroid electromagnet 328 is replaced with two solenoids 532 and 534. FIG. 12J illustrates an electro-mechanical actuator print head 570 similar to electro-mechanical actuator print head 388, except that the lower half toroid electromagnet 326 is replaced with two solenoids 526 and 528, and the upper half toroid electromagnet 328 is replaced with solenoids 544. FIG. 12K illustrates an electro-mechanical actuator print head 572 similar to electro-mechanical actuator print head 388, except that the lower half toroid electromagnet 326 is replaced with solenoids 540, and the upper half toroid electromagnet 328 is replaced with two solenoids 532 and 534.

Magnet Types

There are many other embodiments of the electro-mechanical actuator print head of the present invention that utilize some combination, but not necessarily all, of three types of magnets: toroid electromagnets, solenoids, and/or permanent magnets as shown in FIGS. 6A–B, 7A–B, 11A–H, and 12A–K. At least one of the magnets must be an electromagnet, either toroidal or solenoid, in order to change magnetic field polarity to move the pin from a non-print position to a print position and from a print position to a non-print position.

A toroidal magnetic circuit provides a closed magnetic flux path which is preferable to a solenoid circuit which does not in and of itself. The closed magnetic flux path creates a stronger electromagnet. In this sense the toroidal shape illustrated in the Figures could be replaced with a horseshoe shaped electromagnet or other similar shaped electromagnet to essentially provide a similar closed magnetic flux path as that produced by a toroidal shaped electromagnet. If a permanent magnet is used with a half toroid electromagnet, it needs to be polarized side to side to align with the magnetic poles of the half toroid electromagnet. If a permanent magnet is used with a solenoid, it needs to be polarized top to bottom to align on the same axis as the poles of the solenoid.

Electromagnets, in general, are preferable to permanent magnets. If a permanent magnet is used, the electromagnet cannot be made appreciably stronger in magnetic field strength than the permanent magnet without demagnetizing the permanent magnet. Electromagnets are generally much stronger than permanent magnets. So, even if the electromagnets has more mass, the increased mass is generally more than compensated for by the increased magnetic field strength.

Electromagnet Equations for Determining Preferred Electromagnet Structures

EQUATIONS 1 through 4 shown below mathematically describe the magnetic tractive force, both attractive and repulsive, of a toroid electromagnet with two air gaps, or rather, two half toroid electromagnets facing each other separated by some distance. It is apparent from the second degree polynomial nature of EQUATION 1 that the flux density B is the most important contributing factor to the magnetic tractive force of the magnetic circuit. EQUATION 2 mathematically describes flux density B as a function of the number of turns of wire in the electromagnet, the electrical current running through the wire, the cross sectional area of the electromagnet core, and the combined reluctance of the magnetic circuit.

EQUATION 1:

$$F = \frac{B^2 A}{2\lambda_0}$$

| | |
|---|---|
| F | Magnetic tractive force in newtons. |
| B | Magnetic flux density of magnetic circuit in tesla. |
| A | Cross sectional area of core in square meters. |
| $\mu_0$ | Magnetic permeability of free space 4π × 10–7 Wb/A.m. |

EQUATION 2:

$$B = \frac{NI}{A(R_i + 2R_g)}$$

| | |
|---|---|
| B | Magnetic flux density of magnetic circuit in tesla. |
| A | Cross sectional area of core in square meters. |
| N | Number of wire turns regardless of number of wire layers. |
| I | Current in amperes. |
| $R_i$ | Reluctance of iron part of magnetic circuit. |
| $R_g$ | Reluctance of air gap. |

EQUATION 3:

$$R_i = \frac{l}{\mu A}$$

| | |
|---|---|
| $R_i$ | Reluctance of iron part of magnetic circuit. |
| l | Length of iron part of magnetic circuit. |
| μ | Magnetic permeability of electromagnet core. |
| A | Cross sectional area of core in square meters. |

EQUATION 4:

$$R_g = \frac{g}{\mu_0 A}$$

| | |
|---|---|
| $R_g$ | Reluctance of air gap. |
| g | Length of air gap. |
| $\mu_0$ | Magnetic permeability of free space 4π × 10–7 Wb/A.m. |
| A | Cross sectional area of electromagnet core in square meters. |

The reluctance of the magnetic circuit must be kept low in relation to the number of turns of wire and the current to achieve substantial flux density. In other words, even if the number of turns of wire and the current running through that wire are measurably high, it is not of much value unless the reluctance of the circuit is kept low. The reluctance of the core of the electromagnet $R_i$, as shown in EQUATION 3, depends on the length, magnetic permeability, and cross sectional area of the magnetic circuit. Because the magnetic permeability of the core is generally high, the reluctance of the core is generally low. However, when considering the reluctance of the air gaps of the magnetic circuit $R_g$, as shown in EQUATION 4, the magnetic permeability of air is extremely low. This makes the length and cross sectional area of the air gaps in the magnetic circuit the critical factor in achieving high flux density and more importantly high magnetic tractive force.

The toroidal shape of the magnetic circuit comprised in the preferred embodiment of the electro-mechanical actuator print head is a rather natural shaped in view of EQUATIONS 1 through 4. When a toroid has a uniform winding of many wire turns, the magnetic lines of flux are almost entirely confined to the interior of the winding, flux density being substantially zero outside the winding. In other words, the shape provides a substantially continuous magnetic flux path. Since the length of the air gaps is significantly short, there is very little, if any, magnetic flux leakage from the magnetic circuit.

The solenoids, seen so proliferously in the conventional electro-mechanical actuator impact print head, have a much longer magnetic circuit length. To avoid completing the magnetic circuit through the air, which has an extremely low magnetic permeability and extremely high reluctance, the previous solutions have employed extremely cumbersome means to complete the magnetic circuit through some higher magnetically permeable medium. These add considerable mass and size to the print head.

The toroidal shape of the electromagnetic circuits in the preferred embodiment of the electro-mechanical actuator print head avoids the limitations of the previous conventional solenoid print heads. The added mass of the H-bar electromagnet is more than compensated for in the following ways: (1) the attractive and/or repulsive forces above and below the H-bar electromagnet provide enough force to compensate for the extra mass; (2) the H-bar electromagnet with a substantially shorter pin replaces the considerably longer pin, permanent magnet, spring, and lever of conventional electro-mechanical print heads; (3) the resistive force of the cantilevered armatures of some of the conventional electro-mechanical print heads is eliminated; (4) most of the friction in conventional electro-mechanical print heads caused by bending the pin through the print head structure, the fulcrum and lever, pin return spring, the pin going through an ink ribbon or film, and the cantilevered armature pushing the lever back into the solenoid has been eliminated; and (5) the tubular pin with ink inside has less mass than a solid metal pin.

EQUATION 5 shown below calculates magnetic tractive force as a function of distance with a constant initial flux density. EQUATIONS 6 through 11 shown below provide for the calculation of the electro-mechanical actuator cycle time. EQUATIONS 12 and 14 shown below calculate the inductance and distributive capacitance, respectively, of the electromagnet for EQUATION 15 shown below which calculates the maximum frequency of the electromagnet. EQUATIONS 16 and 17 shown below calculate the power dissipation of electromagnets.

EQUATION 5:

This equation calculates the magnetic tractive force as a function of distance. Only the flux density at one centimeter, using the cgs system, is required. The magnetic tractive force of electromagnets vary inversely to the square of the distance between them.

$$F = \frac{m}{d^2} = \frac{B^2A}{200000\,\mu_0 d^2}$$

| | |
|---|---|
| F | Magnetic tractive force in dynes. |
| B | Magnetic flux density in tesla. |
| A | Cross sectional area of core in square meters. |
| μ | Magnetic tractive force at 1 cm in unit poles (cgs system). |
| $\mu_0$ | Magnetic permeability of free space 4π × 10–7 Wb/A.m. |
| d | Distance in centimeters. |

EQUATIONS 6–11:

These equations calculate position, velocity, and acceleration as a function of time. They can be used to calculate the cycle time of the electro-mechanical actuators. The differential equations corresponding to position, velocity, and acceleration are as follows:

| | |
|---|---|
| x"(t) | Acceleration at time t. |
| x'(t) | Velocity at time t. |
| x(t) | Position at time t. |

EQUATION 6:

$$F = ma$$

| | |
|---|---|
| F | Magnetic tractive force in dynes. |
| μ | Mass of print element in grams. |
| a | Acceleration in centimeters per second per second. |

EQUATION 7:

$$a = \frac{d^2x}{dt^2}$$

EQUATION 8:

$$F(t) = \frac{md^2x(t)}{dt^2}$$

EQUATION 9:

$$F(t) = mx''(t) = \frac{md^2x}{dt^2}$$

EQUATION 10:

$$F(t) = mx''(t) = \frac{\pm k}{x(t)^2}$$

*k* Magnetic tractive force at 1 cm in unit poles (*cgs* system).

EQUATION 11:

EQUATIONS 12 & 13:

$$x''(t) = \frac{\pm k}{mx\,(t)^2}$$

Inductance of long solenoid and toroid electromagnets, respectively.

$$L = \frac{\mu N^2 A}{l}$$

$$L = \frac{\mu(Nr)^2}{2R}$$

| | |
|---|---|
| L | Inductance of electromagnet in henries. |
| μ | Magnetic permeability of core in henries per meter. |
| N | Number of turns of wire, dimensionless. |
| A | Cross sectional area in square meters. |
| l | Length of solenoid in meters. |
| r | Radius of toroid coil in meters. |
| R | Radius of toroid in meters. |

EQUATION 14:

Distributive capacitance of electromagnet.

$$C_d = \frac{\pi D}{3.6\cosh^{-1}(s/d)}$$

| | |
|---|---|
| $C_d$ | Distributive capacitance of electromagnet in pico farads. |
| D | Diameter of coil at wire center in millimeters. |
| d | Diameter of wire in millimeters. |
| s | Spacing between turns at wire centers in millimeters. |
| $\cosh^{-1}$ | Inverse hyperbolic cosine. |

EQUATION 15:

Electromagnet resonant frequency. Also called self-resonant frequency, sinusoidal frequency.

$$f = \frac{1}{2\pi\sqrt{LC_{sd}}}$$

| | |
|---|---|
| f | Resonant frequency of electromagnet in hertz. |
| L | Inductance of electromagnet in henries. |
| $C_d$ | Distributive capacitance of electromagnet in farads. |

EQUATION 16:

Electromagnet coil power dissipation.

$$W = I^2R$$

| | |
|---|---|
| W | Power in watts. |
| I | Current in amperes. |
| R | Resistivity of conductor in ohms. |

EQUATION 17:

Electromagnet power dissipation broken down for radiation and convection.

$$I^2R = W_cA_c + W_rA_r$$

| | |
|---|---|
| I | Current in amperes. |
| R | Resistivity of conductor in ohms. |
| $W_c$ | Watts loss per square inch due to convection. |
| $W_r$ | Watts loss per square inch due to radiation. |
| $A_c$ | Surface area of conductor in square inches (convection). |
| $A_r$ | Surface area of conductor in square inches (radiation). |

Electromagnet Optimization Algorithm

The following algorithm represents a preferred method of determining through a software program running on a computer the various parameters specifications of the electromagnets in the electro-mechanical actuator print heads according to the present invention:

```
CONSTANTS: voltage
INITIALIZE VARIABLES
FOR each coil length & diameter, wire diameter, core permeability &
saturation:
    COMPUTE number of wire layers:
        INPUT coil diameter & wire diameter.
    COMPUTE core diameter:
        INPUT layers, coil diameter, & wire diameter.
    COMPUTE wire length:
        INPUT layers, wire diameter, core diameter, & coil length.
    COMPUTE electrical current in amperes:
        INPUT voltage, wire length, wire weight & resistance.
    IF current > maximum current:
        THEN current = maximum current.
    COMPUTE wire turns:
        INPUT layers, wire diameter, & coil length.
    COMPUTE flux density & tractive force of electromagnet:
        INPUT wire turns, current, coil length, core diameter.
        INPUT core permeability & saturation.
        IF flux density > saturation:
            THEN flux density = saturation.
    COMPUTE number of actuators that will fit in a given area:
        INPUT area & electromagnet area.
    IF actuators * tractive force > maximum so far:
        SAVE optimum electromagnet specifications.
PRINT optimum electromagnet specifications.
```

Preferred Ink-Jet Print Head

Figure 14A:
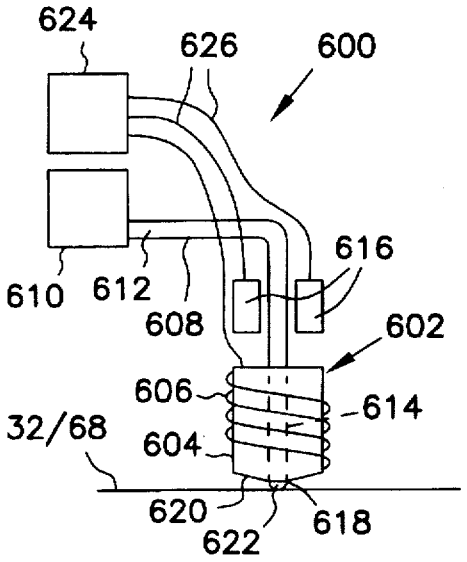
FIG. 14A is a schematic diagram illustrating an ink-jet print head according to the present invention.

An ink-jet print head according to the present invention is generally indicated at 600 in FIG. 14A. Ink-jet print head 600 comprises a solenoid type electromagnet 602 consisting of a cylinder of magnetically permeable material 604 wrapped with electrically insulated and conductive wire 606. An ink tube 608 carrying ink 612 is attached at one end to a hollow cylindrical core 614 in solenoid 602 and to an ink reservoir 610 holding ink 612 at the other end. Optional charging plates 616 optionally electrically charge ink 612 before the ink enters solenoid electromagnet 602. Thus, ink 612 is electrically charged or magnetized prior to entering solenoid 602.

Core 614 opens at an opening 618 in an end 620 of solenoid 602. The diameter of opening 618 is so small that the surface tension of ink 612 keeps the ink inside solenoid 602. An electrical current causes solenoid 602 to attract ink 612 into its core 614 at one end and repel ink from its core at the other end through opening 618 to form a droplet of ink 622 at opening 618. The droplet of ink 622 overcomes the surface tension of the ink as the magnetically tractive forces, both attractive and repulsive, of solenoid 602 and ink 612 to force the droplet from core 614 of the solenoid onto the printing medium. The resulting suction of the droplet of ink 622 leaving core 614 of solenoid 602 as well as the magnetically attractive forces at the other end of the solenoid draw fresh ink 612 into the core of the solenoid from ink reservoir 610 through ink tube 608.

An AC power controller 624 provides power to insulated electrical conductor 606 which surrounds solenoid 602. AC power controller 624 also supplies power to optional charging plates 616 through wires 626. AC power controller 624 preferably controls the current to electrical conductors 606 and 624 to properly energize optional charging plates 616 and solenoid 602 to the correct plurality to achieve the above described magnetic flux to force the ink drop 622 from the solenoid at the proper time as controlled by software running on computer 52.

Figure 14B:
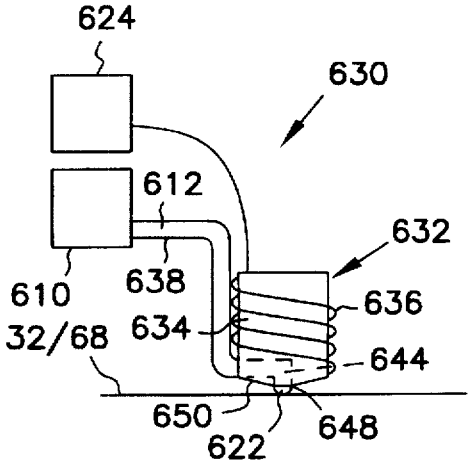
FIG. 14B is a schematic diagram illustrating another embodiment of an ink-jet print head according to the present invention.

Another ink-jet print head according to the present invention is generally indicated at 630 in FIG. 14B. Ink-jet print head 630 comprises a solenoid type electromagnet 632 consisting of a cylinder of magnetically permeable material 634 wrapped with electrically insulated and conductive wire 636. An ink tube 638 carrying ink 612 is attached at one end to a cylindrical L-shaped hollow portion 644 in solenoid 632 and to ink reservoir 610 holding ink 612 at the other end. Ink 612 is magnetized prior to entering solenoid 632.

Cylindrical L-shaped hollow portion 644 opens at an opening 648 in an end 650 of solenoid 632. The diameter of opening 648 is so small that the surface tension of ink 612 keeps the ink inside solenoid 632. An electrical current causes solenoid 632 to be the same magnetic polarity as ink 612 to repel ink 612 from its cylindrical L-shaped hollow portion 644 through opening 648 to form a droplet of ink 622 at opening 648. The droplet of ink 622 overcomes the surface tension of the ink as the magnetically repulsive forces of solenoid 632 and ink 612 to force the droplet from cylindrical L-shaped hollow portion 644 of the solenoid onto the printing medium. The resulting suction of the droplet of ink 622 leaving cylindrical L-shaped hollow portion 644 of solenoid 632 as well as the magnetically repulsive forces of the solenoid and ink draw fresh ink 612 into the cylindrical L-shaped hollow portion of the solenoid from ink reservoir 610 through ink tube 638.

AC power controller 624 provides power to insulated electrical conductor 636 which surrounds solenoid 632. AC power controller 624 preferably controls the current to electrical conductor 636 to properly energize solenoid 602 to the correct polarity to achieve the above described magnetic flux to force the ink drop 622 from the solenoid at the proper time as controlled by software running on computer 52.

The solenoid ink-jet print head according to the present invention generates heat similar to the heat generated by an electro-mechanical actuator print head. Therefore, a cooling system, such as cooling system 440 illustrated in FIG. 10, is preferably used to effectively cool the solenoid electromagnets of the ink-jet print heads to a temperature below the melting point for any of the components of the ink-jet print heads substantially exposed to the heat generated by the solenoids, including the solenoids.

If no cooling system, such as cooling system 440 is used, the typical solenoid actuator print head requires a substantial reduced duty cycle, such as a 25% duty cycle. If the above described cooling system 440 is employed in the printing system according to the present invention, the duty cycle can be increased to a 100% duty cycle, if necessary. Of course, the solenoids the ink-jet print heads according to the present invention can also be cooled less effectively, but less expensively, with some type of conventional air cooling device to somewhat increase the duty cycle.

Bubble-Jet Print Head

Figure 15:
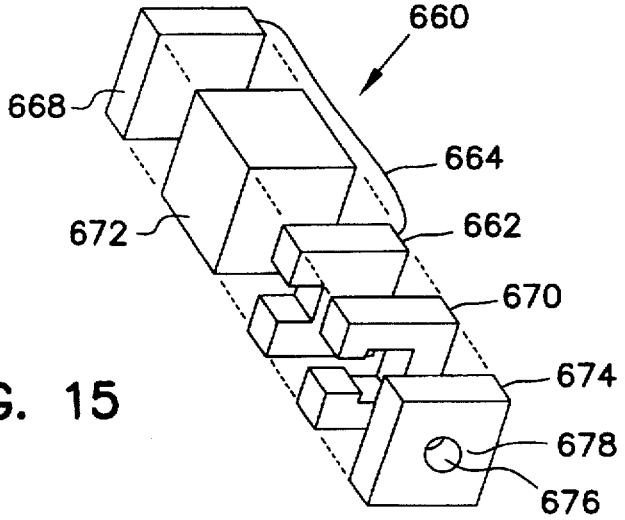
FIG. 15 is an exploded perspective view, in schematic diagram form, of a bubble jet or thermal ink-jet print head for use in the print head array according to the present invention.

A conventional bubble-jet print head is generally illustrated in a an exploded perspective view at 660 in FIG. 15. Bubble-jet print head 660 comprises a thin film resistor 662 which is electrically connected to insulated electrical conductor 664. A power controller 668 provides power to insulated electrical conductor 664, and preferably controls the current to electrical conductor 664 to properly energize thin film resister 662 to achieve the below described heating of the thin film resister at the proper time as controlled by software running on computer 52

Bubble-jet print head 660 also includes a firing chamber 670 connected to an ink reservoir 672. An electrical current provided from power controller 668 flows through thin resistor 662 to heat a thin layer of ink in firing chamber 670 to more than 900° Fahrenheit for a few millionths of a second. The ink boils and forms a bubble of vapor. The bubble expands and pushes the ink from firing chamber 670 through a nozzle 674 to form a droplet at a hole 676 in a tip 678 of the nozzle.

The diameter of hole 676 in nozzle 674 is so small that the surface tension of the ink keeps the ink inside the nozzle. The droplet of ink overcomes the surface tension of the ink as the pressure of the vapor bubble forces the droplet of ink onto the printing medium. Thin film resistor 664 cools and the vapor bubble collapses. The resulting suction pulls fresh ink from ink reservoir 672 into firing chamber 670.

If bubble-jet print heads is used in the print head array according to the present invention, the bubble-jet print heads are optionally cooled with some type of cooling system if necessary to increase the duty cycle. However, the cooling system must not cool the bubble-jet print heads to the point where the thin film resisters do not boil the ink inside of the corresponding firing chambers.

Specifications of the Printing System of Present Invention

TABLE I below shows the printing speed of the printing system according to the present invention in pages per minute (PPM) and dots per second (DPS) based on: resolution in dots per linear inch (DPI); the cycles per second of the actuators (CPS); the distance between actuator centers (DIST); and the number of actuators in the print head array (ACT). The following assumptions are made in TABLE I: 100% ink coverage on 8.5"×11" page; no variable sized dots; and a capable paper delivery mechanism.

TABLE I

| DPI | CPS | DIST | ACT | PPM | DPS |
|---|---|---|---|---|---|
| 300 | 100 | 1/4 | 1496 | 1.07 | 149600 |
| 300 | 1000 | 1/4 | 1496 | 10.67 | 1496000 |
| 300 | 10000 | 1/4 | 1496 | 106.67 | 14960000 |
| 600 | 100 | 1/4 | 1496 | 0.27 | 149600 |
| 600 | 1000 | 1/4 | 1496 | 2.67 | 1496000 |
| 600 | 10000 | 1/4 | 1496 | 26.67 | 14960000 |
| 1200 | 100 | 1/4 | 1496 | 0.07 | 149600 |
| 1200 | 1000 | 1/4 | 1496 | 0.67 | 1496000 |
| 1200 | 10000 | 1/4 | 1496 | 6.67 | 14960000 |
| 2400 | 100 | 1/4 | 1496 | 0.02 | 149600 |
| 2400 | 1000 | 1/4 | 1496 | 0.17 | 1496000 |
| 2400 | 10000 | 1/4 | 1496 | 1.67 | 14960000 |
| 300 | 100 | 1/8 | 5984 | 4.27 | 598400 |
| 300 | 1000 | 1/8 | 5984 | 42.67 | 5984000 |
| 300 | 10000 | 1/8 | 5984 | 426.67 | 59840000 |
| 600 | 100 | 1/8 | 5984 | 1.07 | 598400 |
| 600 | 1000 | 1/8 | 5984 | 10.67 | 5984000 |
| 600 | 10000 | 1/8 | 5984 | 106.67 | 59840000 |
| 1200 | 100 | 1/8 | 5984 | 0.27 | 598400 |
| 1200 | 1000 | 1/8 | 5984 | 2.67 | 5984000 |
| 1200 | 10000 | 1/8 | 5984 | 26.67 | 59840000 |
| 2400 | 100 | 1/8 | 5984 | 0.07 | 598400 |
| 2400 | 1000 | 1/8 | 5984 | 0.67 | 5984000 |
| 2400 | 10000 | 1/8 | 5984 | 6.67 | 59840000 |
| 300 | 100 | 1/16 | 23936 | 17.07 | 2393600 |
| 300 | 1000 | 1/16 | 23936 | 170.67 | 23936000 |
| 300 | 10000 | 1/16 | 23936 | 1706.67 | 239360000 |
| 600 | 100 | 1/16 | 23936 | 4.27 | 2393600 |
| 600 | 1000 | 1/16 | 23936 | 42.67 | 23936000 |
| 600 | 10000 | 1/16 | 23936 | 426.67 | 239360000 |
| 1200 | 100 | 1/16 | 23936 | 1.07 | 2393600 |
| 1200 | 1000 | 1/16 | 23936 | 10.67 | 23936000 |
| 1200 | 10000 | 1/16 | 23936 | 106.67 | 239360000 |
| 2400 | 100 | 1/16 | 23936 | 0.27 | 2393600 |
| 2400 | 1000 | 1/16 | 23936 | 2.67 | 23936000 |
| 2400 | 10000 | 1/16 | 23936 | 26.67 | 239360000 |
| 300 | 100 | 1/32 | 95744 | 68.27 | 9574400 |
| 300 | 1000 | 1/32 | 95744 | 682.67 | 95744000 |
| 300 | 10000 | 1/32 | 95744 | 6826.67 | 957440000 |
| 600 | 100 | 1/32 | 95744 | 17.07 | 9574400 |
| 600 | 1000 | 1/32 | 95744 | 170.67 | 95744000 |
| 600 | 10000 | 1/32 | 95744 | 1706.67 | 957440000 |
| 1200 | 100 | 1/32 | 95744 | 4.27 | 9574400 |
| 1200 | 1000 | 1/32 | 95744 | 42.67 | 95744000 |
| 1200 | 10000 | 1/32 | 95744 | 426.67 | 957440000 |
| 2400 | 100 | 1/32 | 95744 | 1.07 | 9574400 |
| 2400 | 1000 | 1/32 | 95744 | 10.67 | 95744000 |
| 2400 | 10000 | 1/32 | 95744 | 106.67 | 957440000 |
| 300 | 100 | 1/64 | 382976 | 273.07 | 38297600 |
| 300 | 1000 | 1/64 | 382976 | 2730.673 | 82976000 |
| 300 | 10000 | 1/64 | 382976 | 27306.6 | 3829760000 |
| 600 | 100 | 1/64 | 382976 | 68.27 | 38297600 |
| 600 | 1000 | 1/64 | 382976 | 682.67 | 382976000 |
| 600 | 10000 | 1/64 | 382976 | 6826.67 | 3829760006 |
| 1200 | 100 | 1/64 | 382976 | 17.07 | 38297600 |
| 1200 | 1000 | 1/64 | 382976 | 170.67 | 382976000 |
| 1200 | 10000 | 1/64 | 382976 | 1706.67 | 3829760000 |
| 2400 | 100 | 1/64 | 382976 | 4.27 | 38297600 |
| 2400 | 1000 | 1/64 | 382976 | 42.67 | 382976000 |
| 2400 | 10000 | 1/64 | 382976 | 426.67 | 3829760000 |

Advantages of Printing System of Present Invention

One of the advantages of the print head array according to the present invention is that more dots per second per area can be printed as compared to a conventional dot matrix printer, because more print heads provide more ink coverage in less time. Therefore, the increased printing speed also translates into increased resolution. Another advantage is that a four color process can be printed in the same area as one color by some print heads assigned to each of the four colors.

In addition, paper can move continuously through the printing system. Therefore, there are no limitations on vertical resolution due to paper movement as with conventional dot matrix printing systems. The vertical resolution is not limited by mechanical incremental movements. The print head according to the present invention can move continuously and bi-directionally across the paper. Therefore, there are no limitations on horizontal resolution due to spacing of print elements.

The print head array structure according to the present invention also permits use of efficient cooling systems which equates to 100% duty cycles.

Advantages of Preferred Electro-Mechanical Actuator Print Head

The mechanical actuator print head described above has many distinct advantages over conventional impact pin matrix technologies. The attractive and repulsive magnetic tractive forces of the electromagnets of the present invention are much stronger than the forces produced with permanent magnets to allow for increased transition speeds between the print and non-print positions and the non-print and print positions.

The closed magnetic circuit of toroid electromagnets of the present invention provides stronger magnetic forces, faster actuator cycles, more dots per second, and substantially zero magnetic flux leakage. In addition, by having the pin in contact with printing medium for shorter period, the electro-mechanical print head according to the present invention permits faster movement of the printing medium and print head array without smearing the ink on the printing medium. Moreover, the cycle time is not substantially fixed by the return spring of the conventional dot matrix electro-mechanical impact print head.

The electro-mechanical actuator print head according to the present invention also eliminates the friction of bending pins, fulcrum and lever, springs, ribbon/film, of the conventional electro-mechanical actuator impact print heads.

The economical and efficient cooling system of the present invention permits the electro-mechanical actuator print head of the present invention to operated at the 100% duty cycle.

Increased actuator speed allows faster movement of printing medium and print head array. Increased printing speed also translates into increased resolution. Thus, the resolution produced by the electro-mechanical actuator print head according to the present invention permits better quality dots than conventional electro-mechanical actuator impact print head pin matrix and ink jet print heads.

The tubular pins according to the present invention place well defined droplets of ink rather than smudges of ink produced by conventional pins and ribbons, rather than the splattered ink produced by conventional ink-jet print heads. The smaller dots than an ink-jet print head provide for finer resolution.

Substantially zero electromagnetic radiation is produced by the toroidal shaped electromagnets of the present invention.

The non-impact electro-mechanical actuator print heads according to the present invention eliminate wear on ends of pins as in conventional impact print heads. Therefore, the non-impact actuator print heads significantly increase actuator life span. The non-impact electro-mechanical actuator print heads according to the present invention are significantly quieter than conventional impact print heads. As a result the non-impact print heads are cost effective to sound insulate.

Advantages of Preferred Ink-jet Actuator

The ink-jet print head according to the present invention has no moving parts, and is easily manufactured. Less heat is generated from the ink-jet print head as compared to the electro-mechanical print head. The ink-jet print head according to the present invention does not require the droplet deflection of the conventional ink jet print heads.

The ink-jet print head according to the present invention increases speed at which printing medium and print head array can move. First, the cooling system according to the present invention economically and efficiently cools the solenoid ink-jet print head to permit a 100% duty cycle. Second, the fast actuator speed of the ink-jet print head according to the present invention allows faster movement of the printing medium and the print head array. Increased the printing speed also translates into increased resolution.

Determining the Type of Print Head to Utilize in the Print Head Array

The conventional bubble-jet actuator print head is smaller in size, which increased speed per given area. The conventional bubble-jet print head has no moving parts, and is easily manufactured. The bubble-jet print head generates less heat. Droplet deflection is not required with the bubble-jet print head.

Therefore, given the above described advantages of the present inventions non-impact electro-mechanical actuator print head and the electro-mechanical actuators provide the best resolution, while the bubble jet actuators provide the best speed. Dual technology print head arrays will provide the best resolution and speed.

Conclusion

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A printing system for printing an image including image portions and having a defined image width on a printing surface of a printing medium, comprising:

a print head array including multiple columns of print heads, wherein each column includes a plurality of print heads having varying positions in a first dimension in the print head array for printing in a corresponding printable column area of the printing medium having a corresponding defined printable column width, wherein the multiple columns of print heads are arranged for printing throughout the defined image width of the image;

a first mechanism for moving, in the first dimension, the printing medium relative to the print head array to cause selected non-contiguous portions of a defined printable segment along a second dimension substantially perpendicular to the first dimension to be printed in each printable column area by the print heads having varying positions in the first dimension if a corresponding image portion is contained in the selected non-contiguous portions of the corresponding defined printable segment of the corresponding printable column area, and wherein further movement in the first dimension causes selected non-contiguous portions of multiple defined printable segments to be printed to fill the corresponding image portions of each column area; and a second mechanism for moving, in the second dimension, the print head array relative to the printing medium, wherein a movement in the second dimension not more than a widest distance between any two consecutive non-contiguous portions of any defined printable segment in combination with the movement in the first dimension is sufficient to print all defined printable segments contained in the image.

2. The printing system of claim 1 wherein the print head array comprises electro-mechanical actuator print heads.

3. The printing system of claim 2 wherein the electro-mechanical actuator print heads comprise tubular pins which can print the image on the printing medium without impacting the printing medium.

4. The printing system of claim 2 wherein the electro-mechanical actuator print heads comprise toroid shaped electromagnets.

5. The printing system of claim 1 wherein the print head array comprises ink-jet print heads.

6. The printing system of claim 5 wherein the ink-jet print heads comprise solenoid type electromagnets.

7. The printing system of claim 1 wherein the print head array comprises bubble jet printing heads.

8. The printing system of claim 7 wherein the print head array further comprises mechanical actuator print heads.

9. The printing system of claim 1 wherein the first mechanism moves the printing medium in a continuous movement.

10. The printing system of claim 1 wherein the first mechanism moves the printing medium in relatively small incremental movements.

11. The printing system of claim 1 further comprising:

cooling means for cooling the printing heads.

12. A method of printing an image including image portions and having a defined image width on a printing surface of a printing medium, the method comprising the steps of:

arranging print heads in an array including multiple columns of print heads, wherein each column includes a plurality of print heads having varying positions in a first dimension in the array for printing in a corresponding printable column area of the printing medium having a corresponding defined printable column width, wherein the multiple columns of print heads are arranged for printing throughout the defined image width of the image;

moving, in the first dimension, the printing medium relative to the print head array to cause selected non-contiguous portions of a defined printable segment along a second dimension substantially perpendicular to the first dimension to be printed in each printable column area by the print heads having varying positions in the first dimension if a corresponding image portion is contained in the selected non-contiguous portions of the corresponding defined printable segment of the corresponding printable column area;

further moving, in the first dimension, the printing medium relative to the print head array to cause selected non-contiguous portions of multiple defined printable segments printed to fill the corresponding image portions of each column area; and moving, in the second dimension, the print head array relative to the printing medium, wherein a movement in the second dimension not more than a widest distance between any two consecutive non-contiguous portions of any defined printable segment in combination with the movement in the first dimension is sufficient to print all defined printable segments contained in the image.

13. The method of claim 12 wherein the steps of moving the printing medium relative to the print head array in the first dimension involve the step of moving the printing medium in a continuous movement.

14. The method of claim 12 wherein the steps of moving the printing medium relative to the print head array in the first dimension involve the step of moving the printing medium in relatively small incremental movements.

15. The method of claim 12 further comprising the step of cooling the printing heads.

16. A printing system for printing an image having a defined image width and a defined image length on a printing surface of a printing medium, comprising:

a print head array including multiple columns and rows of print heads arranged for printing throughout the defined image width and the defined image length of the image, wherein each print head is assigned a corresponding printable area of the printing medium having a corresponding defined area width and a defined area length;

a first mechanism for moving, in a first dimension, the print head array relative to the printing medium, wherein a movement in the first dimension not more than the defined area length of a longest printing area is sufficient to print throughout the defined image length of the image; and a second mechanism for moving, in a second dimension substantially perpendicular to the first dimension, the print head array relative to the printing medium, wherein a movement in the second dimension not more than the defined area width of a widest printing area is sufficient to print throughout the defined image width of the image.

17. The printing system of claim 16 wherein the print head array comprises electro-mechanical actuator print heads.

18. The printing system of claim 17 wherein the electro-mechanical actuator print heads comprise tubular pins which can print the image on the printing medium without impacting the printing medium.

19. The printing system of claim 17 wherein the electro-mechanical actuator print heads comprise toroid shaped electromagnets.

20. The printing system of claim 16 wherein the print head array comprises ink-jet print heads.

21. The printing system of claim 20 wherein the ink-jet print heads comprise solenoid type electromagnets.

22. The printing system of claim 16 wherein the print head array comprises bubble jet printing heads.

23. The printing system of claim 22 wherein the print head array further comprises mechanical actuator print heads.

24. The printing system of claim 16 further comprising a third mechanism for moving the printing medium in a continuous movement.

25. The printing system of claim 16 wherein further comprising a third mechanism for moving the printing medium in relatively small incremental movements.

26. The printing system of claim 16 wherein at least one row is comprises print heads, which are staggered by having varying positions in the first dimension.

27. The printing system of claim 16 wherein at least one column comprises print heads, which are staggered by having varying positions in the second dimension.

28. The printing system of claim 16 further comprising:

cooling means for cooling the printing heads.

29. A method of printing an image having a defined image width and a defined image length on a printing surface of a printing medium, comprising the steps of:

arranging print heads in an array of print heads including multiple columns and rows of print heads arranged for printing throughout the defined image width and the defined image length of the image;

assigning each print head to a corresponding printable area of the printing medium having a corresponding defined area width and a defined area length;

moving, in a first dimension, the print head array relative to the printing medium, wherein a movement in the first dimension not more than the defined area length of a longest printing area is sufficient to print throughout the defined image length of the image; and moving, in a second dimension substantially perpendicular to the first dimension, the print head array relative to the printing medium, wherein a movement in the second dimension not more than the defined area width of a widest printing area is sufficient to print throughout the defined image width of the image.

30. The method of claim 29 further comprising the step of moving the printing medium in a continuous movement in the first dimension.

31. The method of claim 29 further comprising the step of moving the printing medium in relatively small incremental movements in the first dimension.

32. The method of claim 29 further comprising the step of cooling the printing heads.

* * * * *